US009816714B2

(12) United States Patent
Breshears

(10) Patent No.: US 9,816,714 B2
(45) Date of Patent: Nov. 14, 2017

(54) RAINSCREEN WITH INTEGRATED HEAT AND MOISTURE EXCHANGER

(71) Applicant: Architectural Applications P.C., Portland, OR (US)

(72) Inventor: John Edward Breshears, Portland, OR (US)

(73) Assignee: Architectural Applications P.C., Portland, OR (US)

( * ) Notice: Subject to any disclaimer, the term of this patent is extended or adjusted under 35 U.S.C. 154(b) by 0 days.

(21) Appl. No.: 14/886,753

(22) Filed: Oct. 19, 2015

(65) Prior Publication Data

US 2016/0109142 A1 Apr. 21, 2016

Related U.S. Application Data

(60) Provisional application No. 62/065,945, filed on Oct. 20, 2014.

(51) Int. Cl.

| | |
|---|---|
| ***F24F 3/147*** | (2006.01) |
| ***F28D 21/00*** | (2006.01) |
| *F24F 3/14* | (2006.01) |
| *F24F 5/00* | (2006.01) |

(52) U.S. Cl.

CPC ..... *F24F 3/147* (2013.01); *F28D 21/0015* (2013.01); *F24F 2003/1435* (2013.01); *F24F 2005/0082* (2013.01)

(58) Field of Classification Search

CPC .. F24F 12/006; F24F 2003/1435; F24F 3/147; F24F 2005/0082; F28D 21/0015

USPC ..... 165/54, 53, 66; 95/45; 96/4, 7

See application file for complete search history.

(56) References Cited

U.S. PATENT DOCUMENTS

| | | | |
|---|---|---|---|
| 246,626 | A | 9/1881 | Morse |
| 549,765 | A | 11/1895 | Calver |
| 2,288,465 | A | 6/1942 | Knudsen |
| 2,595,905 | A | 5/1952 | Telkes |

(Continued)

FOREIGN PATENT DOCUMENTS

| | | | |
|---|---|---|---|
| CA | 1113789 | A1 | 12/1981 |
| EP | 0661502 | A2 | 7/1995 |

(Continued)

OTHER PUBLICATIONS

Jan. 6, 2016, International Search Report of the International Searching Authority of the U.S. Receiving Office in PCT/US2015/056214, which is the international application to this U.S. application.

(Continued)

*Primary Examiner* — Orlando E Aviles Bosques
*Assistant Examiner* — Raheena R Malik
(74) *Attorney, Agent, or Firm* — Kolisch Hartwell, P.C.

(57) ABSTRACT

A method of controlling moisture reaching a building façade may include providing a weather resistant building shield, the shield including first and second subchannels. The building shield may be disposed parallel to an inner façade and separated from the inner façade by an air gap. The method may include causing input air to flow through the first subchannel at an input air flow rate and causing exhaust air to flow through the second subchannel at an exhaust air flow rate. Controlling at least one of the input and exhaust air flow rates may provide control over moisture content in the gap.

14 Claims, 10 Drawing Sheets

(56) References Cited

U.S. PATENT DOCUMENTS

| | | | | |
|---|---|---|---|---|
| 3,666,007 | A | 5/1972 | Yoshino et al. | |
| 3,720,025 | A | 3/1973 | Eichman | |
| 3,785,931 | A | 1/1974 | Coffey et al. | |
| 3,860,055 | A | 1/1975 | Wild | |
| 3,866,672 | A | 2/1975 | Rich, Jr. et al. | |
| 3,923,461 | A | 12/1975 | Barden | |
| 3,925,212 | A | 12/1975 | Tchernev | |
| 3,925,945 | A | 12/1975 | White | |
| 3,926,561 | A | 12/1975 | Lucero | |
| 3,955,555 | A | 5/1976 | Boström | |
| 3,977,466 | A | 8/1976 | Johansson | |
| 3,981,294 | A | 9/1976 | Deminet et al. | |
| 4,019,868 | A | 4/1977 | Sebacher et al. | |
| 4,031,680 | A | 6/1977 | Stoakes | |
| 4,040,804 | A | 8/1977 | Harrison | |
| 4,050,443 | A | 9/1977 | Peck et al. | |
| 4,068,652 | A | 1/1978 | Worthington | |
| 4,159,707 | A | 7/1979 | Miquel | |
| 4,173,253 | A | 11/1979 | Wiegand | |
| 4,182,406 | A | 1/1980 | Holbrook et al. | |
| 4,183,398 | A | 1/1980 | Ehrke | |
| 4,232,731 | A | 11/1980 | Kaplow et al. | |
| 4,259,401 | A | 3/1981 | Chahroudi et al. | |
| 4,269,171 | A | 5/1981 | McArthur | |
| 4,270,516 | A | 6/1981 | Hopper et al. | |
| 4,285,332 | A | 8/1981 | McHugh | |
| 4,301,787 | A | 11/1981 | Rice | |
| 4,331,066 | A | 5/1982 | Schmidlin | |
| 4,338,996 | A | 7/1982 | Frank | |
| 4,369,765 | A | 1/1983 | McDaniel | |
| 4,382,436 | A | 5/1983 | Hager | |
| 4,393,861 | A | 7/1983 | Beard et al. | |
| 4,393,961 | A | 7/1983 | Boon | |
| 4,412,528 | A | 11/1983 | Elzinga, Jr. | |
| 4,418,378 | A | 11/1983 | Johnson | |
| 4,436,084 | A | 3/1984 | Carlston et al. | |
| 4,469,087 | A | 9/1984 | Cameron | |
| 4,478,210 | A | 10/1984 | Sieradski | |
| 4,484,938 | A | 11/1984 | Okamoto et al. | |
| 4,577,619 | A | 3/1986 | Howe, Jr. | |
| 4,582,129 | A | 4/1986 | Yano et al. | |
| 4,609,039 | A | 9/1986 | Fushiki et al. | |
| 4,658,806 | A | 4/1987 | Boozer | |
| 4,691,763 | A | 9/1987 | Kennedy | |
| 4,867,134 | A | 9/1989 | O'Brien | |
| 4,872,503 | A | 10/1989 | Marriner | |
| 4,903,503 | A | 2/1990 | Meckler | |
| 4,913,818 | A | 4/1990 | Van Wijk et al. | |
| 4,932,982 | A | 6/1990 | Hayes | |
| 4,950,314 | A | 8/1990 | Yamada et al. | |
| 5,069,272 | A | 12/1991 | Chagnot | |
| 5,082,173 | A | 1/1992 | Poehlman et al. | |
| 5,181,387 | A | 1/1993 | Meckler | |
| 5,182,921 | A | 2/1993 | Yan | |
| 5,240,480 | A | 8/1993 | Thorogood et al. | |
| 5,551,991 | A | 9/1996 | Avero | |
| 5,569,633 | A | 10/1996 | Carolan et al. | |
| 5,617,913 | A | 4/1997 | DeGregoria et al. | |
| 5,681,368 | A | 10/1997 | Rahimzadeh | |
| 5,733,435 | A | 3/1998 | Prasad et al. | |
| 5,788,748 | A | 8/1998 | Mazanec et al. | |
| 5,855,972 | A | 1/1999 | Kaeding | |
| 5,976,220 | A | 11/1999 | Braun et al. | |
| 6,054,229 | A | 4/2000 | Hsu et al. | |
| 6,059,862 | A | 5/2000 | Mizobe et al. | |
| 6,126,723 | A | 10/2000 | Drost et al. | |
| 6,145,588 | A * | 11/2000 | Martin | F24F 3/147 165/133 |
| 6,176,305 | B1 * | 1/2001 | Haglid | F24F 5/0035 165/231 |
| 6,178,966 | B1 * | 1/2001 | Breshears | F24F 3/147 126/629 |
| 6,273,180 | B1 | 8/2001 | Joshi et al. | |
| 6,319,115 | B1 | 11/2001 | Shingaki | |
| 6,361,588 | B1 * | 3/2002 | Moratalla | B01D 53/22 55/521 |
| 6,401,428 | B1 | 6/2002 | Glover et al. | |
| 6,413,298 | B1 | 7/2002 | Wnek et al. | |
| 6,532,952 | B1 | 3/2003 | Kreamer | |
| 6,635,104 | B2 | 10/2003 | Komkova et al. | |
| 6,789,612 | B1 * | 9/2004 | Okamoto | H05K 7/206 165/104.33 |
| 6,866,701 | B2 | 3/2005 | Meirav | |
| 7,013,950 | B2 | 3/2006 | Steneby et al. | |
| 7,036,560 | B1 | 5/2006 | Rylewski | |
| 7,083,110 | B2 | 8/2006 | Kim et al. | |
| 7,231,967 | B2 * | 6/2007 | Haglid | B25B 27/0035 165/231 |
| 7,604,689 | B2 | 10/2009 | Siverklev | |
| 7,641,545 | B2 * | 1/2010 | Chen | E06B 7/02 126/633 |
| 8,496,732 | B2 | 7/2013 | Culp et al. | |
| 8,500,848 | B2 | 8/2013 | Claridge et al. | |
| 8,641,806 | B2 | 2/2014 | Claridge et al. | |
| 8,685,144 | B2 | 4/2014 | Claridge et al. | |
| 8,685,145 | B2 | 4/2014 | Claridge et al. | |
| 9,347,675 | B2 | 5/2016 | Breshears | |
| 2001/0018962 | A1 | 9/2001 | Joshi et al. | |
| 2002/0104439 | A1 | 8/2002 | Komkova et al. | |
| 2004/0226685 | A1 | 11/2004 | Gagnon et al. | |
| 2005/0072303 | A1 | 4/2005 | Weidenmann | |
| 2007/0125111 | A1 | 6/2007 | Xiao | |
| 2007/0151447 | A1 | 7/2007 | Merkel | |
| 2008/0086981 | A1 | 4/2008 | Kilkis et al. | |
| 2008/0230206 | A1 | 9/2008 | Lestage et al. | |
| 2008/0283217 | A1 | 11/2008 | Gagnon et al. | |
| 2009/0025710 | A1 | 1/2009 | Hogan | |
| 2010/0319370 | A1 | 12/2010 | Kozubal et al. | |
| 2011/0146941 | A1 | 6/2011 | Benoit et al. | |
| 2012/0012290 | A1 * | 1/2012 | Breshears | F24F 3/147 165/164 |
| 2012/0118145 | A1 | 5/2012 | Claridge et al. | |
| 2012/0118146 | A1 | 5/2012 | Claridge et al. | |
| 2012/0118147 | A1 | 5/2012 | Claridge et al. | |
| 2012/0118155 | A1 | 5/2012 | Claridge et al. | |
| 2013/0020049 | A1 * | 1/2013 | Breshears | F24F 12/006 165/53 |
| 2013/0126123 | A1 * | 5/2013 | Breshears | F24F 3/147 165/54 |
| 2013/0312929 | A1 | 11/2013 | Breshears | |
| 2014/0034268 | A1 | 2/2014 | Breshears | |
| 2014/0041830 | A1 * | 2/2014 | Breshears | F24F 3/147 165/54 |
| 2015/0034283 | A1 | 2/2015 | Breshears | |

FOREIGN PATENT DOCUMENTS

| | | | |
|---|---|---|---|
| FR | 2853048 | B1 | 4/2006 |
| GB | 2081877 | A | 2/1982 |
| JP | 54145048 | A | 11/1979 |
| JP | 56030555 | A | 3/1981 |
| JP | 59001989 | A | 1/1984 |
| JP | 09318099 | A | 12/1997 |
| WO | 2005090873 | A1 | 9/2005 |
| WO | 2008106973 | A1 | 9/2008 |
| WO | 2013012639 | A1 | 1/2013 |

OTHER PUBLICATIONS

Jan. 6, 2016, Written Opinion of the International Searching Authority of the U.S. Receiving Office in PCT/US2015/056214, which is the international application to this U.S. application.

Asaeda et al., "Experimental Studies of Dehumidification of Air by an Improved Ceramic Membrane", Presented at the 50th Annual Meeting of the Society of Chemical Engineers, Yokohama, Japan, Mar. 1985, Journal of Chemical Engineering of Japan, pp. 238-240.

Kunzel, Hartwig M., Simultaneous Heat and Moisture Transport in Building Components, One- and two-dimensional calculation using simple parameters, Frauhofer Institute of Building Physics, 1995, pp. 1-65.

(56) References Cited

OTHER PUBLICATIONS

Sep. 27, 2012, International Search Report of the International Searching Authority from the U.S. Receiving Office, in PCT/US2012/046299, which is another application of Architectural Applications P.C.
Sep. 27, 2012, Written Opinion of the International Searching Authority from the U.S. Receiving Office, in PCT/US2012/046299, which is another application of Architectural Applications P.C.
Jul. 16, 2013, Office action from the U.S. Patent and Trademark Office, in U.S. Appl. No. 13/747,218, which is another application of Architectural Applications P.C.
Dec. 5, 2013, Office action from the U.S.Patent and Trademark Office, in U.S. Appl. No. 13/747,218, which is another application of Architectural Applications P.C.
Dec. 19, 2013, First Action Pilot Program Pre-Interview Communication from the U.S. Patent and Trademark Office, in U.S. Appl. No. 13/185,439, which is another application of Architectural Applications P.C.
Jan. 2, 2014, First Action Pilot Program Pre-Interview Communication from the U.S. Patent and Trademark Office, in U.S. Appl. No. 13/185,435, which is another application of Architectural Applications P.C.
Jan. 21, 2014, International Preliminary Report on Patentability from the International Bureau of WIPO, in PCT/US2012/046299, which is another application of Architectural Applications P.C.
Apr. 1, 2014, Office action from the U.S. Patent and Trademark Office, in U.S. Appl. No. 13/185,439, which is another application of Architectural Applications P.C.
Apr. 1, 2014, Office action from the U.S. Patent and Trademark Office, in U.S. Appl. No. 13/185,435, which is another application of Architectural Applications P.C.
Aug. 1, 2014, Office action from the U.S. Patent and Trademark Office, in U.S. Appl. No. 13/185,439, which is another application of Architectural Applications P.C.
Aug. 1, 2014, Office action from the U.S. Patent and Trademark Office, in U.S. Appl. No. 13/185,435, which is another application of Architectural Applications P.C.
Nov. 26, 2014, Office action from the U.S. Patent and Trademark Office, in U.S. Appl. No. 13/185,439, which is another application of Architectural Applications P.C.
Jan. 30, 2015, Office action from the U.S. Patent and Trademark Office, in U.S. Appl. No. 13/942,376, which is another application of Architectural Applications P.C.
Apr. 8, 2015, First Action Interview Pilot Program Pre-Interview Communication from the U.S. Patent and Trademark Office, in U.S. Appl. No. 14/518,451, which is another application of Architectural Applications P.C.
Jun. 18, 2015, Office action from the U.S. Patent and Trademark Office, in U.S. Appl. No. 14/518,451, which is another application of Architectural Applications P.C.
Jul. 9, 2015, First Action Interview Pilot Program Pre-Interview Communication from the U.S. Patent and Trademark Office, in U.S. Appl. No. 14/053,921, which is another application of Architectural Applications P.C.
Aug. 6, 2015, Office action from the State Intellectual Property Office of the People's Republic of China, in Chinese Patent Application No. 201280045105.8, which is another application of Architectural Applications P.C.
Sep. 17, 2015, Office action from the U.S. Patent and Trademark Office, in U.S. Appl. No. 14/053,921, which is another application of Architectural Applications P.C.
Feb. 24, 2016, Office action from the U.S. Patent and Trademark Office, in U.S. Appl. No. 14/997,872, which is another application of Architectural Applications P.C.
May 25, 2016, Office action from the State Intellectual Property Office of the People's Republic of China, in Chinese Patent Application No. 201280045105.8, which is another application of Architectural Applications P.C.
Jun. 28, 2016, Search Report and Written Opinion from the Intellectual Property Office of Singapore, in Singapore Patent Application No. 11201505573Y, which is another application of Architectural Applications P.C.
Sep. 13, 2016, Office action from the U.S. Patent Trademark Office in U.S. Appl. No. 15/155,315, which is another application of Applicant Architectural Applications P.C.
May 4, 2017, final Office action from the S Patent Trademark Office in U.S. Appl. No. 15/155,315, which is another application of Applicant Architectural Applications P.C.
Apr. 25, 2017, International Preliminary Report on Patentability from the International Searching Authority in PCTUS2015056214, which is the international application to this U.S. application.

* cited by examiner

RAINSCREEN WITH INTEGRATED HEAT AND MOISTURE EXCHANGER

CROSS-REFERENCE TO RELATED APPLICATIONS

This application claims priority from U.S. Provisional Patent Application Ser. No. 62/065,945 filed Oct. 20, 2014 which is incorporated herein by reference. This application incorporates by reference in their entirety for all purposes the following: U.S. Pat. No. 6,178,966, issued Jan. 30, 2001; U.S. Patent Application Pub. No. 2012/0012290; U.S. Patent Application Pub. No. 2013/0312929; and U.S. Patent Application Pub. No. 2014/0041830.

BACKGROUND

In heated or cooled buildings, fresh air or "makeup air" is typically added continuously to the total volume of circulated air. A corresponding amount of previously heated or cooled air is then exhausted from the building space. This can result in an undesirable loss of energy, as the fresh air is brought to the same temperature and humidity as the treated air that will be exhausted to the external environment. Heat exchangers are commonly used in the exhaust and makeup airflow pathways of these systems to recover some of the lost energy. Such exchangers may be used to induce warmer makeup air during heating processes and cooler makeup air during cooling processes. Moisture exchangers may also be used to either remove or add moisture to the makeup air so that it more closely matches the treated air to be exhausted.

Materials commonly used for heat exchangers include metal foils and sheets, plastic films, paper sheets, and the like. These systems can be effective at transferring thermal energy but are not effective at transferring moisture. Materials used for moisture exchangers include desiccants or other moisture adsorbing materials. These can be effective at holding moisture, but releasing said moisture into the makeup air requires additional mechanical energy to relocate the material or thermal energy to induce the desiccant to desorb the accumulated moisture.

The various types of heat and moisture exchangers in common usage are generally located at or near the building air-handling units in the mechanical room or basement, or on the rooftop of the building. The nature of moisture exchange requires a very large surface area in contact with the gas stream and, consequently, so-called total heat exchangers are often very large in size when compared to heat-only exchangers. A single, large exchanger in a conventional location requires additional space and/or additional load-carrying capacity of the roof in the case of a rooftop unit, incurring a financial penalty in the cost of the building construction or modification.

Instead of using a single, large, central unit to precondition the stream of makeup air, multiple smaller units may be used and distributed throughout the building. For example, U.S. Pat. No. 6,178,966 to Breshears describes a heat and moisture exchange apparatus configured to be integrated in the exterior walls of a building. Such units may face numerous challenges. First, creating a pathway from the external fresh air into the interior building space may require breaching the waterproof barrier around the building. Second, smaller exchange units may have difficulty adequately separating the inlet and outlet points of the makeup air stream from the outlet and inlet points of the exhaust air stream, respectively, to ensure that recently introduced fresh air is not immediately exhausted out of the building and that recently exhausted air is not immediately recirculated back into the building.

SUMMARY

A method of controlling moisture reaching a building façade may include providing a weather-resistant building shield. The building shield may include an exterior weather-resistant face, an interior face, and a membrane parallel to and disposed between the exterior face and the interior face and dividing an internal channel of the building shield into first and second subchannels. The shield may include a first intake allowing fluid communication between an environment external to a building and the first subchannel and a second intake allowing fluid communication between an interior of the building and the second subchannel. The shield may include a first egress allowing fluid communication between the first subchannel and the interior of the building and a second egress allowing fluid communication between the second subchannel and the environment external to the building. The method may further include disposing the building shield with the interior face parallel to a building facade and separated from the facade by a gap, and with the exterior face exposed to an environment external to the building. The method may include causing input air to flow into the first intake, through the first subchannel and out of the first egress at an input air flow rate, and causing exhaust air to flow into the second intake, through the second subchannel and out of the second egress at an exhaust air flow rate. The method may include controlling at least one of the input air flow rate and the exhaust air flow rate to provide a desired amount of heat exchange between the building shield and the gap, thereby controlling moisture content in the gap.

A method of ventilating a building may include providing a building shield including a heat and moisture exchanger disposed between an interior face of the building shield and an exterior weather-resistant face of the building shield. The method may include disposing the building shield with the interior face parallel to a front surface of a building and separated from the front surface by a gap, and with the exterior face exposed to an environment external to the building. The method may include causing input air to flow from the environment external to the building into a first subchannel of the exchanger, through the first subchannel and into an interior of the building at an input air flow rate, and causing exhaust air to flow from the interior of the building into a second subchannel of the exchanger, through the second subchannel and to the environment external to the building at an exhaust air flow rate. The method may include controlling at least one of the input air flow rate and the exhaust air flow rate to provide a desired amount of heat exchange between the input air and the exhaust air.

A method of controlling moisture reaching a building inner façade may include providing a building outer facade including a heat and moisture exchanger disposed between an interior face of the outer facade and an exterior weather-resistant face of the outer façade and disposing the outer facade with its interior face parallel to a building inner facade and separated from the inner facade surface by a gap, and with its exterior face exposed to conditions of an ambient outdoor environment. The method may include causing input air to flow from the ambient outdoor environment into a first subchannel of the exchanger, through the first subchannel, across the gap, through the inner facade and into the building at an input air flow rate, and causing exhaust air to flow from the building, across the gap, into a second subchannel of the exchanger separated from the first subchannel by a moisture permeable, gas-impermeable barrier, through the second subchannel and out to the ambient outdoor environment at an exhaust air flow rate. The method may include controlling at least one of the input air flow rate and the exhaust air flow rate to provide a desired amount of heat exchange between the outer facade and the gap, thereby controlling moisture content within the gap.

The present disclosure provides various apparatuses and methods of use thereof. In some embodiments, a method may include actively controlling the moisture content within a building façade structure. In some embodiments, a method may include preconditioning air to be used to ventilate a building. Features, functions, and advantages may be achieved independently in various embodiments of the present disclosure, or may be combined in yet other embodiments, further details of which can be seen with reference to the following description and drawings.

DESCRIPTION

Overview

Various embodiments of an airflow panel having vents configured to vent air into and draw air from an air gap situated between a building façade and a structural wall are described below and illustrated in the associated drawings. Unless otherwise specified, the airflow panel and/or its various components may, but are not required to, contain at least one of the structure, components, functionality, and/or variations described, illustrated, and/or incorporated herein. Furthermore, the structures, components, functionalities, and/or variations described, illustrated, and/or incorporated herein in connection with the present teachings may, but are not required to, be included in other heat and moisture exchangers. The following description of various embodiments is merely exemplary in nature and is in no way intended to limit the disclosure, its application, or uses. Additionally, the advantages provided by the embodiments, as described below, are illustrative in nature and not all embodiments provide the same advantages or the same degree of advantages.

EXAMPLES, COMPONENTS, AND ALTERNATIVES

The following sections describe selected aspects of exemplary heat and moisture exchangers as well as related systems and/or methods. The examples in these sections are intended for illustration and should not be interpreted as limiting the entire scope of the present disclosure. Each section may include one or more distinct inventions, and/or contextual or related information, function, and/or structure.

Example 1

Figure 1:
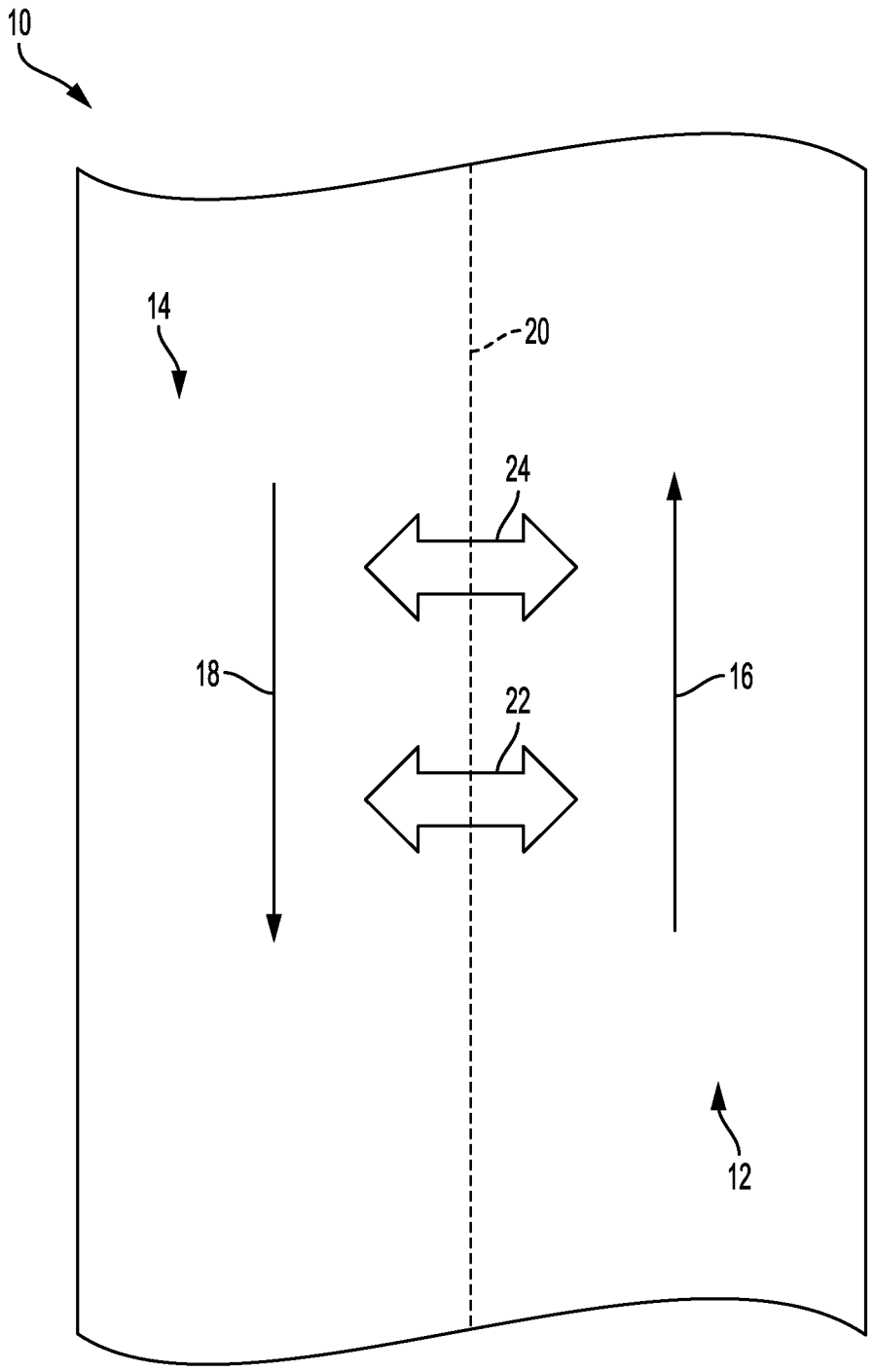
FIG. 1 is a schematic view of a heat and moisture exchanger according to aspects of the present teachings.

This example describes an illustrative heat and moisture exchanger, see FIG. 1.

FIG. 1 is a schematic, partial, sectional view of a heat and moisture exchanger, generally indicated at 10. Exchanger 10 may include a first passage or subchannel 12 and a second passage or subchannel 14. Passage 12 may be configured to carry a stream of exhaust air from an interior space of a building to an exterior space, the flow of exhaust air indicated by arrow 16. Passage 14 may be configured to carry a stream of fresh air or makeup air from an exterior space to an interior space of the building, the flow of makeup air indicated by arrow 18. Air flows 16 and 18 are indicated as counter-propagating in FIG. 1, though it would also be possible to have flows 16 and 18 travelling in the same direction.

The first and second passages 12 and 14 of exchanger 10 may be separated by a barrier or membrane 20. Barrier 20 may be substantially impermeable to constituent gasses of air and substantially permeable by water. An air-impermeable barrier may prevent air that is intended to be exhausted or removed from the interior space of the building from being immediately reintroduced to the building along with the stream of fresh air.

If exhaust stream 16 has higher moisture content than the fresh stream 18, then water may be transferred from the exhaust stream to the makeup air, see double arrow 22. On the other hand, if the fresh air has more moisture, water may be transferred from the fresh air to the exhaust air, see double arrow 22. In this manner, if the fresh air about to be introduced into an interior building space has a different moisture content than the air about to be exhausted from the interior building space, then that difference may be diminished by passing both streams of air through exchanger 10. As the makeup air may be subsequently conditioned by a heating, ventilation, and air-conditioning (HVAC) system upon entering the building space by adding or removing moisture, the heat and moisture exchanger may be said to be pre-conditioning the stream of makeup air. Further, as it may cost energy to remove or add moisture to the fresh air in order to maintain the required internal environmental conditions of the building, preconditioning the makeup air in heat and moisture exchanger 10 may lead to an increase in efficiency, a decrease in energy costs, and/or a decreased load on the HVAC system.

Similarly, the exhaust and makeup streams 16 and 18 may exchange thermal energy through the flow of heat across barrier 20, the flow of heat indicated by double arrow 24. For example, in a heating process, the exhaust air 16 may be at a higher temperature than the incoming fresh air 18. In this case, heat may flow from the exhaust air to the fresh air, thereby raising the temperature of the incoming fresh air and decreasing the amount of energy used by the HVAC system to fully raise the incoming air to room temperature. In another example of a cooling process, the exhaust air 16 may be at a lower temperature than the incoming fresh air 18. In this case, heat may flow from the incoming fresh air to the exhaust air, thereby lowering the temperature of the incoming fresh air and decreasing the amount of energy used by the HVAC system to fully lower the incoming air to room temperature. The rate at which thermal energy is transferred between the makeup air and the exhaust air may depend upon the speed of the streams of air within the exchanger.

Heat and moisture exchanger 10 may form a portion of a wall of a building. Alternately, heat and moisture exchanger 10 may form a portion of one layer in a multi-layer building wall. Heat and moisture exchanger 10 may form a portion of a building façade disposed exterior to a structural wall.

Heat and moisture exchanger 10 may form a portion of a panel that may be incorporated into a multi-layer building wall structure. Some multi-layer building wall structures may include a gap of air between an outer, weather protection layer and an inner, structural support layer. Exchanger 10 may include an exhaust port or ports, not shown in FIG. 1, configured to vent the stream of exhaust air 16 into an internal air gap of a multi-layer wall structure. Exchanger 10 may include an intake port or ports, not shown in FIG. 1, configured to draw the stream of fresh air 18 into the exchanger from the internal air gap in the multi-layer wall.

Membrane 20 may be a substantially planar barrier separating the streams of exhaust air 16 and fresh air 18. In this case, a plane defined by the membrane may be substantially parallel to a plane defined by an exterior surface of the building. Either one of the first and second subchannels may be disposed between the membrane and the exterior surface of the building. Consequently, either one of the second and first subchannels may be disposed between the membrane an interior space of the building.

Example 2

Figure 2:
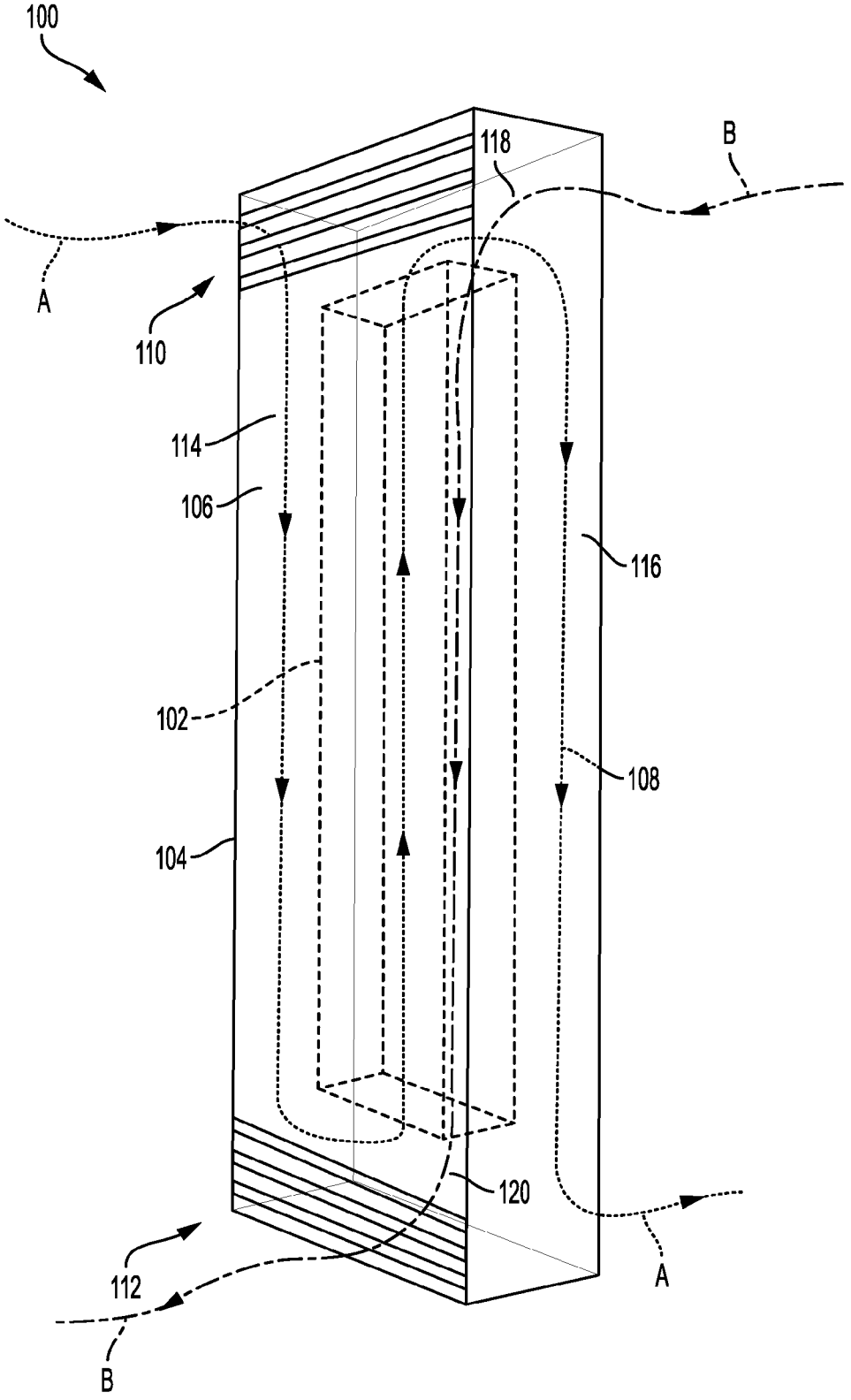
FIG. 2 is a schematic perspective view of an exemplary embodiment of an airflow panel according to aspects of the present teachings.

This example describes an illustrative heat and moisture exchange system, see FIG. 2.

FIG. 2 is schematic perspective view of an exemplary embodiment of an airflow panel, generally indicated at 100. Airflow panel 100 may include a heat and moisture exchanger core 102 and a housing 104. Exchanger core 102 may be contained within housing 104. Exchanger core 102 may have smaller dimensions than housing 104 in order to provide space within the housing for insulation around the exchanger core and/or space for conduits or other air passages, fans, filters, dampers, or other equipment.

The heat and moisture exchanger core 102 may function under the same principles as heat and moisture exchanger 10 described in reference to FIG. 1. Exchanger core 102 may form an internal channel that may be divided into first and second subchannels.

Housing 104 may include an exterior weather-resistant face 106 and an interior face 108. The interior face may be parallel to the exterior weather-resistant face. Exterior face 106 is shown in FIG. 2 as partially transparent in order to view the internal structure of the airflow panel. In a physical embodiment, exterior face 106 may be opaque.

Exterior face 106 may include one or more openings configured to allow the intake or exhaust of air into the airflow panel. For example, exterior face 106 may include an upper opening 110 through which fresh air may enter the airflow panel from the exterior ambient environment. Upper opening 110 may be a series of open slits, holes, or a louver, among others. Exterior face 106 may include a lower opening 112 through which exhaust air may exit the airflow panel to the exterior ambient environment. Lower opening 112 may be a series of open slits, holes, or a louver, among others. The upper and lower openings may be spaced apart from one another along the exterior face 106. This separation may prevent exhausted air from being immediately recirculated back into the building.

Airflow panel 100 may include a first intake 114 configured to direct fresh air from the upper opening to the first subchannel in exchanger core 102. The flow of fresh air through airflow panel 100, also called input air or makeup air, is indicated by curving arrow A. The input air may travel from the upper opening 110, down through the airflow panel, and into the first subchannel proximate the bottom of the exchanger core 102. The input air may travel in a conduit or other passageway, omitted in FIG. 2 for purposes of clarity. Thus, the first intake may provide fluid communication between the exterior face 106 and the first subchannel of the exchanger core 102.

Airflow panel 100 may include a first 116 egress configured to direct the stream of fresh air A out of the first subchannel to a supply port on the interior face 108 of the airflow panel. The flow of fresh air from the first subchannel to the interior face of the airflow panel may be within an internal conduit or passageway not shown in FIG. 2 for purposes of clarity. Thus, the first egress may provide fluid communication between the interior face and the first subchannel of the exchanger core 102.

Airflow panel 100 may include a return port on the interior face 108 of the airflow panel. A stream of exhaust air is indicated by curving arrow B. The stream of exhaust air may enter the airflow panel at the return port in the interior face and be directed through a second intake 118 and into the second subchannel of the exchanger core 102. Thus, the second intake may provide fluid communication between the interior face and the second subchannel.

Airflow panel 100 may include a second egress 120 configured to direct the stream of exhaust air B out of the lower opening 112 of the airflow panel. Thus, the second egress may provide fluid communication between the exterior face 106 and the second subchannel.

The stream of input air A and the stream of exhaust air B may travel through the exchanger core 102 in opposite directions as they exchange heat and moisture. For example, in FIG. 2, the input air is depicted as travelling up through the exchanger core and the exhaust air is depicted as travelling down through the exchanger core. The internal configuration of any conduits or passageways in airflow panel 100 may be such that instead the input air travels down and the exhaust air travels up through the exchanger core, or it may be such that any conduits or passageways conduct air from right to left and vice versa in a lateral direction, or in any other direction with respect to the panel housing.

The return port and the supply port on the interior face may be spaced from one another. This separation may prevent air that has been just added to the interior building space from being immediately exhausted back to the ambient exterior environment.

Airflow panel 100 may form a portion of a building wall. In one example, the exterior surface 106 of the airflow panel may form a portion of the exterior of the building. The interior surface may form a portion of an interior surface of a building. In this case, input air A may directly enter the interior space of the building through the supply port on the interior face 108 of the airflow panel. The airflow panel may include a fan, a damper, and/or an air filter associated with the supply port and the supply port may be covered by a panel which allows the input air to enter the interior building space. Similarly, the exhaust air B may directly exit the interior building space through the return port on the interior surface of the airflow panel. The airflow panel may include a fan, a damper, and/or an air filter associated with the return port and the return port may be covered by a panel which allows the exhaust air to enter the airflow panel.

The input and exhaust streams of air may be made to flow by input and exhaust fans disposed proximate the supply and return ports, respectively. The input air may flow at an input air flow rate and the exhaust air may flow at an exhaust air flow rate. One or both of these flow rates may be controlled by controlling the speed of the return and supply fans.

In another example, airflow panel 100 may form a portion of a multi-layer building wall structure. For example, airflow panel 100 may form a portion of an outer façade of a building. In this case, the streams of input and exhaust air may travel through an appropriate conduit or conduits coupled to the supply and return ports. The streams may travel in these conduits through the remainder of the building wall structure into and out of the interior building space.

Example 3

Figure 3:
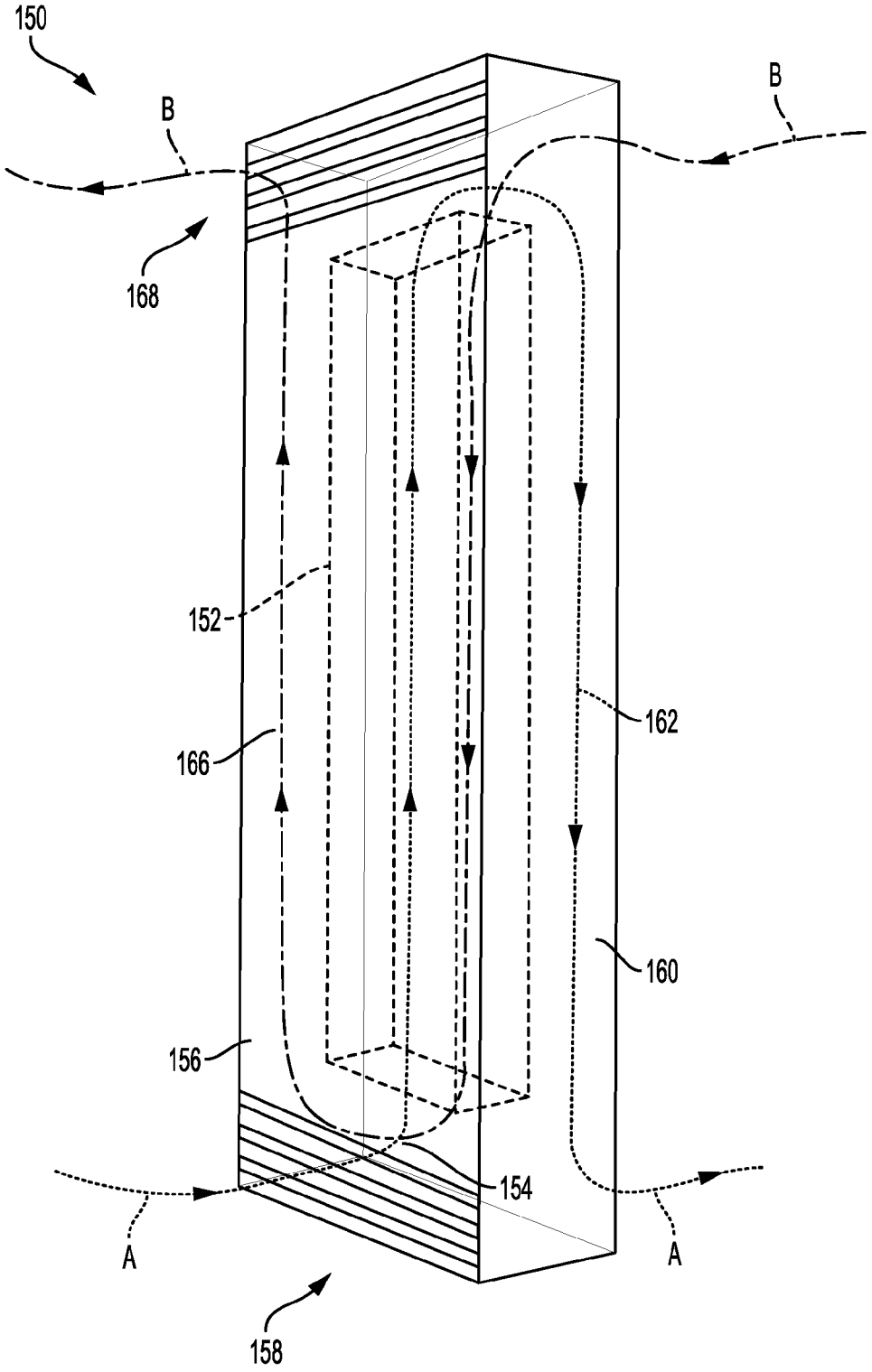
FIG. 3 is a schematic perspective view of another exemplary embodiment of an airflow panel according to aspects of the present teachings.

This example describes another illustrative heat and moisture exchange system, see FIG. 3.

FIG. 3 is schematic perspective view of an exemplary embodiment of an airflow panel, generally indicated at 150. Many aspects of airflow panel 150 may be similar to airflow panel 100. For example, streams of input and exhaust air, denoted by curved arrows A and B respectively, may be spaced from one another as they enter and exit airflow panel 150. Airflow panel 150 may include a heat and moisture exchanger core 152 which may be similar to heat and moisture exchanger core 102 and/or heat and moisture exchanger 10 described in reference to FIG. 1.

Airflow panel 150 may differ from airflow panel 100 in the configuration of internal conduits or passages. A first intake 154 may provide fluid communication between an exterior face 156 and a first subchannel of the exchanger core 152. The first intake may connect to a lower opening 158 which may be similar to lower opening 112. A first egress 160 may provide fluid communication between the interior face and the first subchannel. The first egress may include a conduit, not shown in FIG. 3 for purposes of clarity, for directing the stream of input air A down through the airflow panel to a supply port on an interior face 162 of the panel.

A second intake 164 may provide fluid communication between the interior face 162 and a second subchannel of the exchanger core 152. The second intake may connect to a return port on the interior face of the airflow panel. A second egress 166 may provide fluid communication between the exterior face 156 and the second subchannel of the exchanger core. The second egress may include a conduit, no shown in FIG. 3 for purposes of clarity, for directing the stream of exhaust air B up through the airflow panel to an upper opening 168 on the exterior face 156 of the airflow panel. Upper opening 168 may be similar to upper opening 110.

As with airflow panel 100, airflow panel 150 may form a portion of a building wall or may form a portion of a multi-layer building wall. The discussion of these possibilities will not be repeated here.

Example 4

This example describes an illustrative heat and moisture exchange system, see FIGS. 4-8.

Figure 4:
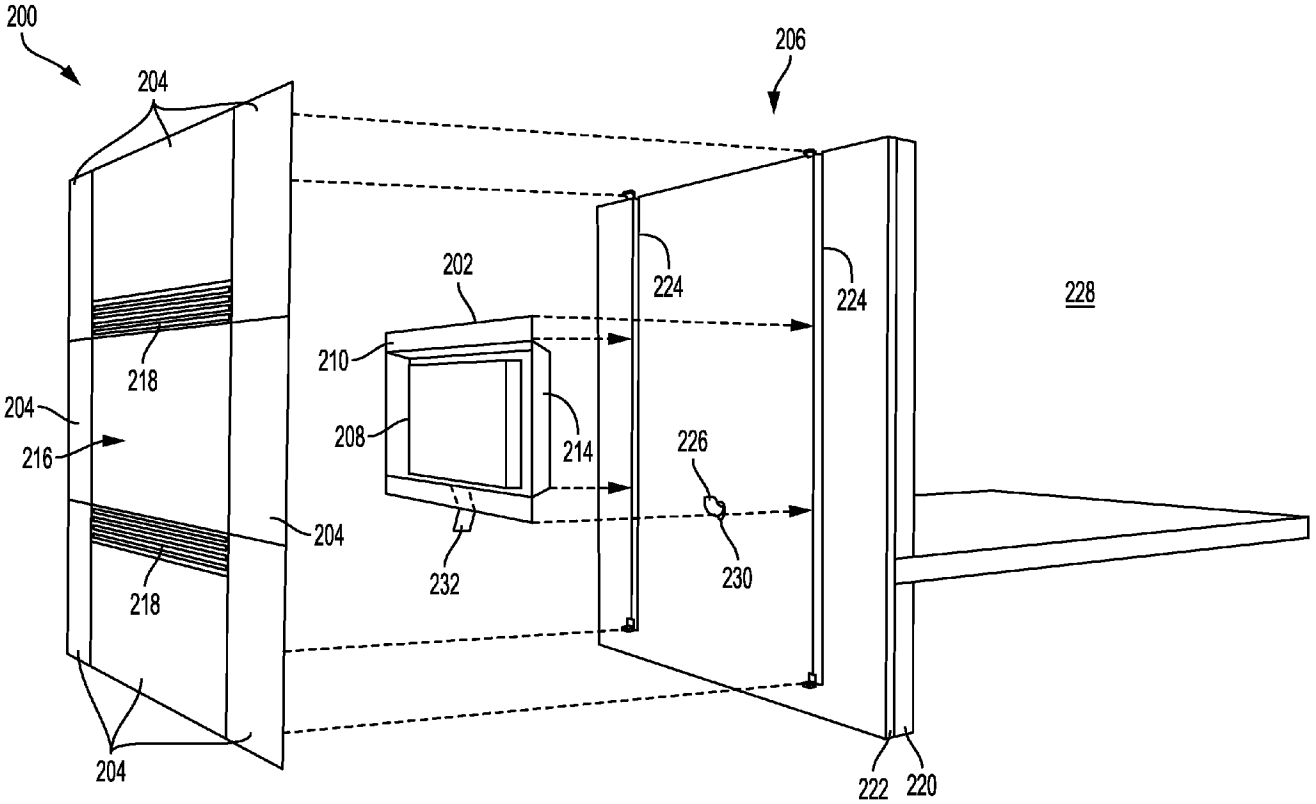
FIG. 4 is an exploded perspective view of an exemplary embodiment of a heat and moisture exchange system, including an airflow panel and other components of a multi-layer building wall, according to aspects of the present teachings.

FIG. 4 is an exploded perspective view of a heat and moisture exchanger system, generally indicated at 200, from a vantage point located outside a building. System 200 may include an airflow panel 202, one or more weather panels 204, and a mounting assembly 206. The dimensions of the airflow panel 202 and the weather panels 204 are exemplary and not meant to be limiting in any way, as there are many different possible lengths, widths, and heights that would be appropriate.

Airflow panel 202 may include a heat and moisture exchanger core 208. Airflow panel 202 is depicted as partially transparent in FIG. 4 in order to view exchanger core 208. In a physical embodiment airflow panel 202 may be opaque. Exchanger core 208 may operate under the same principles as heat and moisture exchanger 10 described in reference to FIG. 1. Airflow panel 202 may include a front face 210, a rear face 212 seen best in FIG. 6, and a peripheral face 214 disposed between the front and rear face. Peripheral face 214 may be composed of one or more surfaces, for example, upper, lower, left, and right surfaces. Together, the front, rear and peripheral faces of the airflow panel may define an interior space in which the exchanger core 208 is disposed. Between the exchanger core 208 and any of the front, rear, or peripheral faces of the airflow panel may be one or more layers of insulation.

The front face 210 of the airflow panel 202 may be substantially resistant to weather effects of the ambient environment. Airflow panel 202, and in particular the front face of the airflow panel, may serve to protect the underlying layers of the building structure from wind, rain, snow, and other weather conditions.

Weather panels 204 may include a plurality of panels of varying dimensions and shapes. Weather panels 204 may form a substantial portion of an outer façade of a building. The weather panels may include an open area 216 of substantially the same dimensions as the front face 210 of airflow panel 202. One or more of the weather panels may include louvers 218. Weather panels 204 may serve to protect the underlying layers of the building structure from wind, rain, snow, and other weather conditions.

Airflow panel 202 and weather panels 204 may be operatively coupled to a structural member 220 of a building wall via the mounting assembly 206. The building wall may include a water/weather resistant or impermeable layer 222 such that liquid entering the gap behind the panels is trapped in the gap and prevented from moving still deeper into the wall layers. Layer 222 may or may not also have an insulation function. Mounting assembly 206 may have any appropriate elements for coupling the panels 202 and 204 to the building wall. For example, mounting assembly 206 may include one or more rails 224. Airflow panel 202 and weather panels 204 may be attached to rails 224 by any appropriate means, for example, by bolts, rivets, screws, nails, pins, etc. Airflow panel 202 and weather panels 204 may be attached to the building wall so that there is a gap of air between the panels 202 and 204 and either the structural member 220 or weather resistant layer 222 if this layer is included.

Heat and moisture exchange system 200 may include a boot or conduit 226. Conduit 226 may penetrate the insulation layer 222 and the structural member 220, and may be configured to allow one or more streams of air to pass between an interior building space 228 and the airflow panel 202. Boot 226 may include an exterior flange 230 configured to seal the passage of the boot through the insulation layer 222 to water and air. Thus, the presence of boot 226 may not substantially affect the ability of layer 222 to repel water.

Exchange system 200 may include a conduit 232 configured to couple boot 226 to airflow panel 202. Conduit 232 may be, for example, a flexible or rigid pipe and may include one or more than one passage through which air may pass. Conduit 232 and boot 226 may together include two passageways, through one of which exhaust air may travel from the interior building space 228 to airflow panel 202 and through the other of which makeup air may travel from the airflow panel 202 to the interior building space 228.

Figure 5:
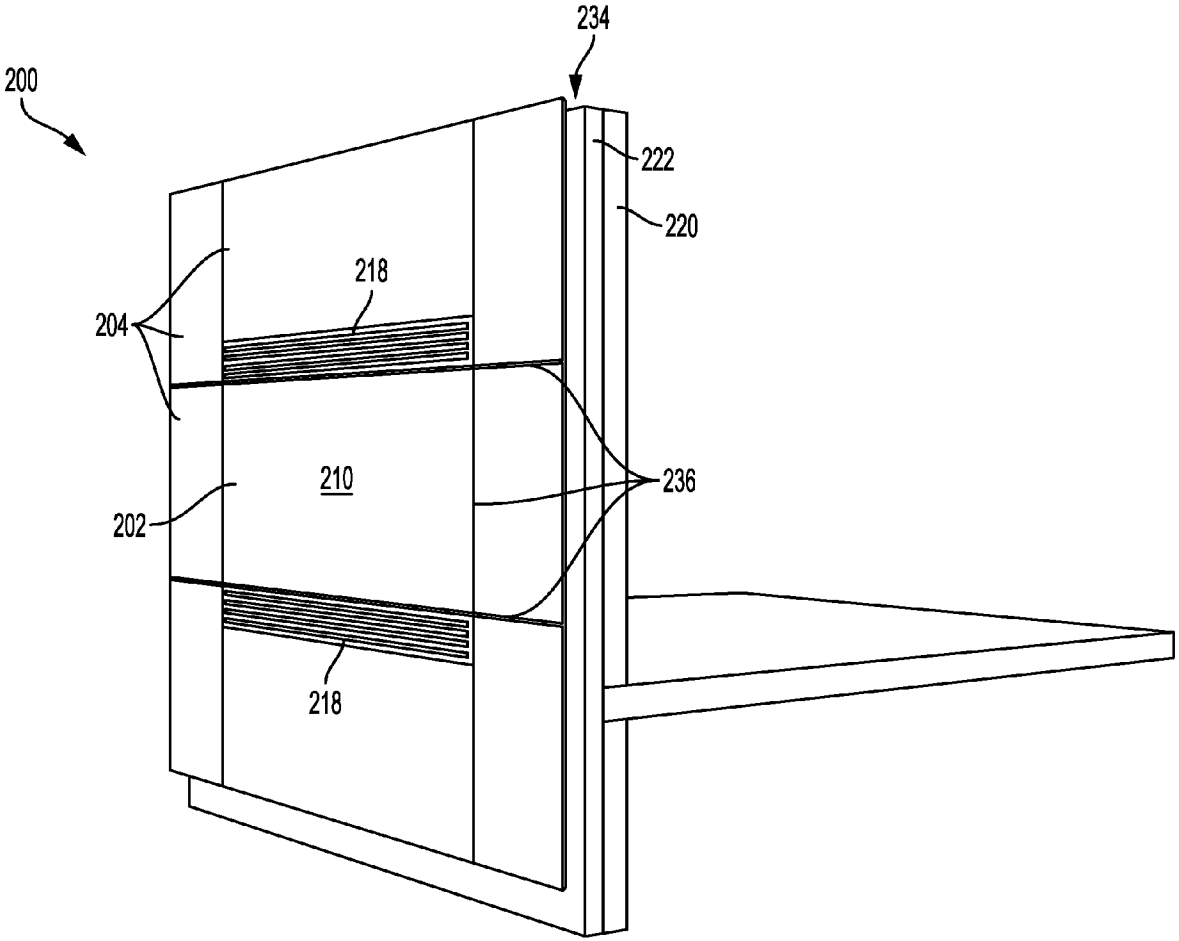
FIG. 5 is a perspective view of the heat and moisture exchange system of FIG. 4 according to aspects of the present teachings.

FIG. 5 is an unexploded perspective view of heat and moisture exchange system 200, showing airflow panel 202 and weather panels 204 attached to structural member 220 and layer 222. There may be an air gap 234 between the weather panels 204 and layer 222. As can be better seen in FIG. 7 below, airflow panel 202 may partially but not completely fill the space between the front face 210 of the panel and layer 222.

The weather panels 204 and one or more airflow panels 202 may together form a façade of a multi-layer building wall structure. The multi-layer building wall structure may include more wall layers than are depicted in FIG. 5, for example, a finished interior wall shown in FIG. 7. The multi-layer building wall structure may include air gap 234.

Weather panels 204 may meet each other and the airflow panel 202 along joints 236. The joints 236 between adjacent panels may be substantially open to the passage of air and water. Thus, the air gap 234 between the façade and the structural member may be in fluid communication with the ambient air outside of the wall.

Water may enter the multi-layer wall structure as liquid water through the façade or as gaseous water vapor that then condenses on an interior surface in the air gap. Water in the air gap may be problematic, as it may provide for the growth of mold or bacteria, the corrosion of materials, and/or may damage structures if the water freezes into ice and expands. In most multi-layer wall structures such as this, the only methods used remove the water from the air gap are passive means such as the undriven circulation of ambient air to evaporate and diffuse the water away and/or gravity to drain the water away in liquid form.

Figure 6:
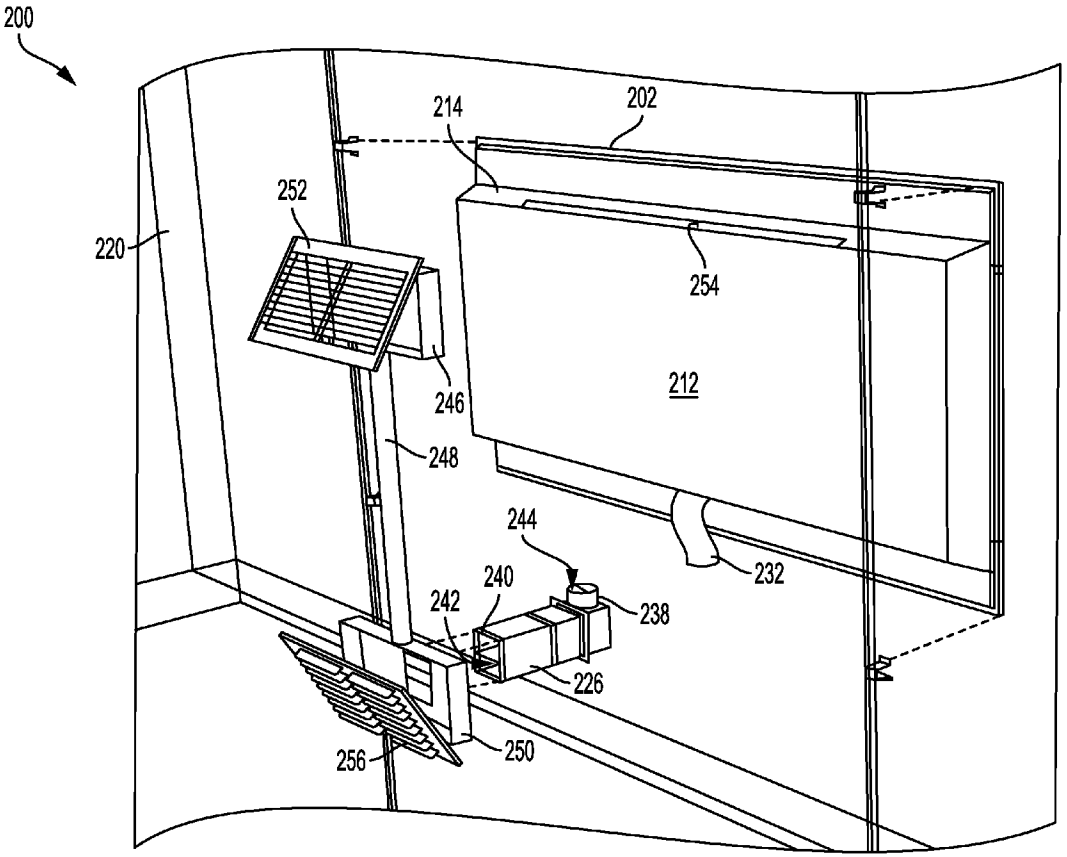
FIG. 6 is an exploded perspective view of the heat and moisture exchange system of FIG. 4 from a vantage point within a building, showing a bifurcated boot configured to allow the passage of air into and out of an interior building space, according to aspects of the present teachings.

FIG. 6 is an exploded, perspective view of heat and moisture exchange system 200, from a vantage point located within the building. Structural member 220 is depicted as transparent in order to view the airflow panel 202 and boot 226.

As can be seen at an exterior end 238 of boot 226 and an interior end 240 of boot 226, the interior space of boot 226 may be divided into two passageways. A first passageway 242 may carry a stream of exhaust air from the interior building space, through the boot, and into the airflow panel. A second passageway 244 may carry a stream of makeup air from the airflow panel, through the boot, and into the interior building space. The flexible or rigid conduit 232 may be divided as well in order to couple the corresponding passages within the boot 226 and the exchanger core within the airflow panel.

Heat and moisture exchange system 200 may include a supply box 246, a snorkel 248, and a return box 250. Supply box 246 may be in fluid communication with the second passageway 244 through snorkel 248 so that the supply of makeup air enters the interior building space through the supply box. The supply box may contain any one of a supply fan, an air filter, and/or a damper. These components may be standard components known to a person skilled in the art. A person may service or replace these components by accessing the supply box through a panel 252. Panel 252 may be substantially flush with an interior wall, floor, or ceiling surface of the interior building space. For example, panel 252 may be substantially flush with a finished interior wall 253. Panel 252 may have passages which allow the stream of makeup air to enter the interior building space. Panel 252 may be a louver.

The stream of fresh input air may enter the air gap 234 through an opening in the building façade, for example through louver 218 or a joint 236 between adjacent weather panels, see FIG. 5. Input air may enter airflow panel 202 through an input port 254. Input port 254 may be disposed on the peripheral surface 214 of the airflow panel 202. Input port 254 may be disposed on an upper portion of the peripheral surface of the airflow panel. Thus, air may be drawn into the interior space of the building from the exterior ambient environment by way of the air gap within the wall structure.

Return box 250 may contain any one of a return fan, an air filter, and/or a damper, as would be known to a person skilled in the art. A person may service or replace these components by accessing the return box through a panel 256. Panel 256 may be substantially flush with an interior wall, floor, or ceiling surface of the interior building space, for example, finished interior wall 253. Panel 256 may have passages which allow the stream of exhaust air to exit the interior building space. Panel 256 may be a louver.

Return box 250 and supply box 246 may be spaced apart from one another within the interior space of the building. Such spacing may prevent fresh makeup air from being immediately exhausted from the interior building space.

Figure 7:
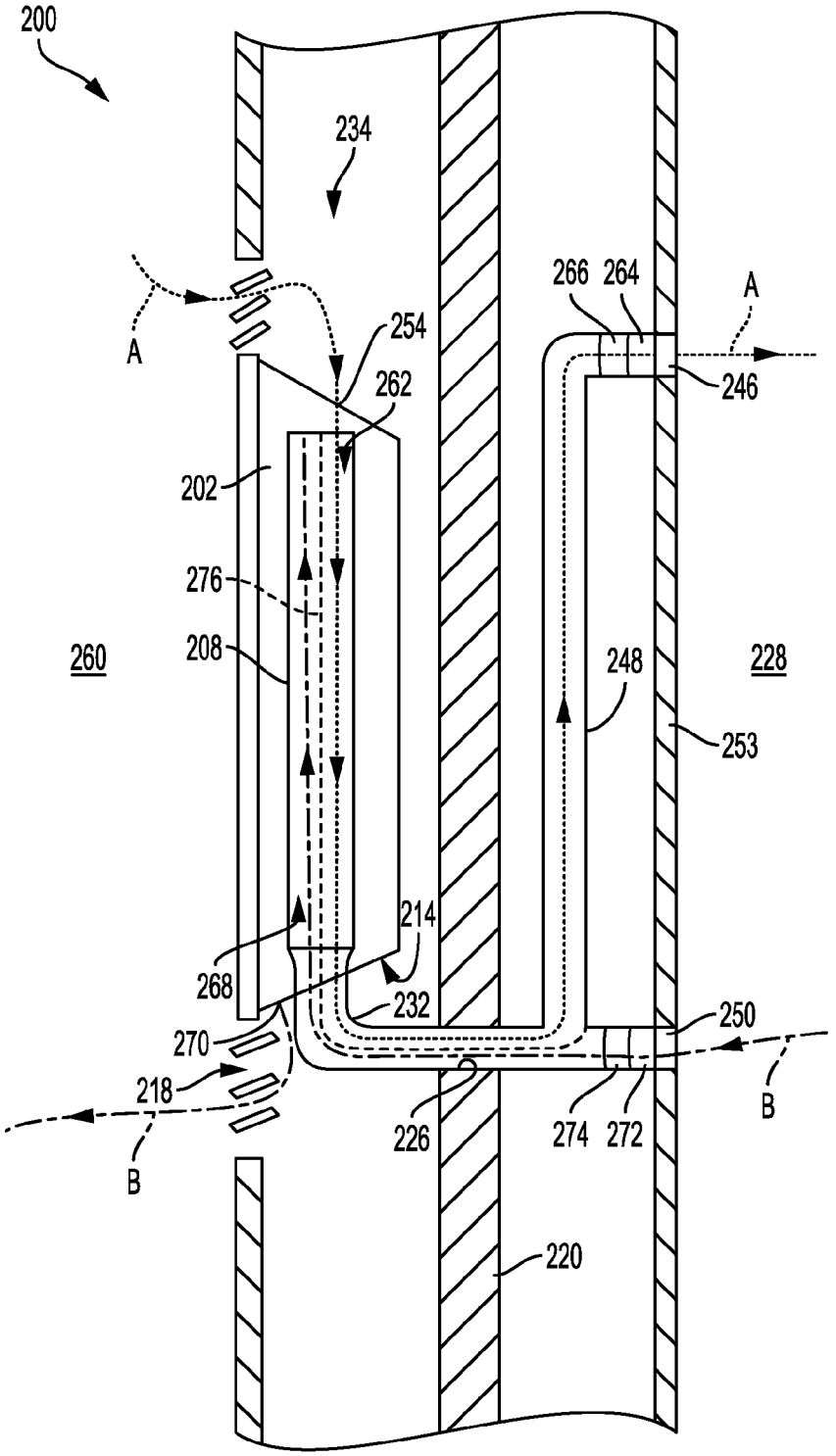
FIG. 7 is a schematic vertical cross-sectional view of the heat and moisture exchange system of FIG. 4 showing a flow of fresh air and a flow of exhaust air, according to aspects of the present teachings.

FIG. 7 is a schematic vertical cross-sectional view of heat and moisture exchange system 200. A stream or flow of fresh air, input air, or makeup air is indicated by curved arrow A. A stream or flow of exhaust air is indicated by curved arrow B.

The stream of input air A may originate from an exterior ambient environment 260 or from within the air gap 234 within the wall structure. Input air may proceed through the input port 254 and down through a first subchannel 262 of the heat and moisture exchanger core 208. Input air may then proceed through the bifurcated conduit 232, the bifurcated boot 226, snorkel 248, and supply box 246 out into the interior building space 228. The flow of input air may be powered by a fan 264 shown schematically proximate the supply box 246. Fan 264 may be adjustable and may be accessed through supply box 246. A damper 266 may control the flow of input air and may be accessed through the supply box.

The stream of exhaust air B may originate in the interior space 228 of the building. Exhaust air may proceed through the return box 250, the bifurcated boot 226, the bifurcated conduit 232 and into a second subchannel 268 of the heat and moisture exchanger core 208. After exiting the second subchannel 268, the exhaust air may be redirected downward through the airflow panel 202, see FIG. 8, and exit through one or more exhaust ports 270. Exhaust port(s) 270 may be disposed on the peripheral surface 214 of the airflow panel 202. Exhaust port(s) 270 may be disposed on a lower portion of the peripheral surface of the airflow panel 202. Thus, the stream of exhaust air B may exit the airflow panel 202 into the air gap 234 of the wall structure. Once the exhausted air has left the airflow panel it may flow out to the ambient environment through a louver 218 or may stay within the air gap 234.

As with the input air, the flow of exhaust air may be driven by a fan 272 shown schematically proximate the supply box. Fan 272 may be adjustable and may be accessed through return box 250. A damper 274 may control the flow of exhaust air and may be access through the return box.

The first and second subchannels 262 and 268 of the heat and moisture exchanger core 208 may be separated by a barrier or membrane 276. Membrane 276 may be substantially impermeable to the components of air and substantially permeable to water. Thus may heat and moisture flow across barrier 276 between the streams of input and exhaust air.

Figure 8:
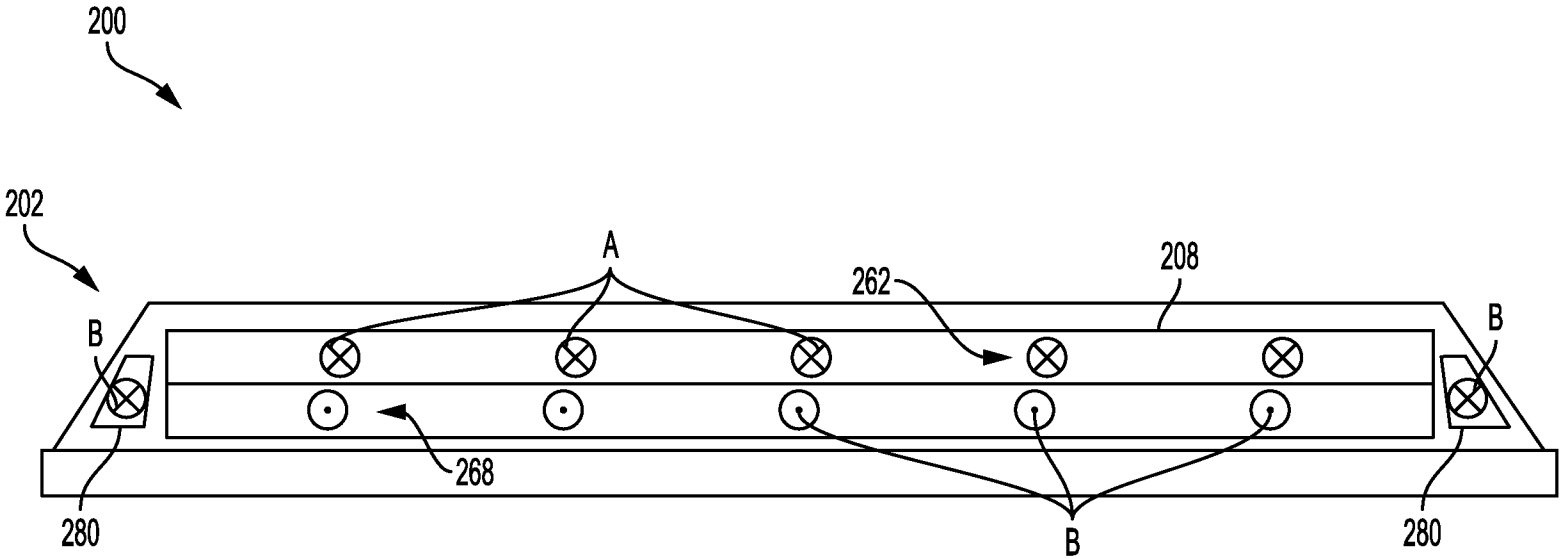
FIG. 8 is a schematic horizontal cross-sectional view of the heat and moisture exchange system of FIG. 4 showing a flow of fresh air and a flow of exhaust air, according to aspects of the present teachings.

FIG. 8 is a schematic horizontal cross-sectional view of airflow panel 202 of the heat and moisture exchange system 200, as viewed from a vantage point above the airflow panel. The flow of input air A may be vertically downward as is indicated by the row of x's within the first subchannel 262 of the heat and moisture exchanger core 208. The flow of exhaust air B within the second subchannel 268 may be vertically upward as is indicated by the row of dots.

Airflow panel 202 may include one or more internal conduits or passageways 280. Conduits 280 may return the flow of exhaust air B from the top of the second subchannel 268 back downwards to the one or more exhaust ports 270 disposed on the lower portion of the peripheral surface 214 of the airflow panel, see FIG. 7. The downward flow of exhaust air within conduits 280 is indicated by the x's within conduits 280.

Example 5

This example describes experiments performed at Lawrence Berkeley National Laboratory. The results of these experiments, for example as depicted graphically in FIG. 9, demonstrate that heat and moisture exchange systems such as those described herein may provide a variable and controllable insulating function.

The present inventor John E. Breshears conducted experiments between Jul. 23 and Aug. 11, 2013 at the Mobile Window Thermal Test (MoWiTT) facility of Lawrence Berkeley National Laboratory in Berkeley, Calif. The purpose of the experiments was to measure overall transfer of air and heat into and out of an enclosed building volume by systems such as those described herein and simultaneously by a control device. More specifically, for both the inventive system and the control device, the experiments were designed to measure (i) the net heat and moisture flux resulting from continuously flowing incoming and exhaust airstreams (the building ventilation function), and (ii) the net heat flux from the inside of the chamber to the external environment via conduction and convection across the major face area of the exchanger housing, which forms a part of the enclosure (the building enclosure or insulation function).

The MoWiTT facility consists of two side-by-side, room-sized (approximately 9'-10"×8'-0"×7'-10" high) calorimeters. Each calorimeter includes a guard air plenum in the exterior surfaces in order to measure net heat flow into or out of the calorimetric chambers with high accuracy. Each chamber has an aperture of approximately 4'-0"×3'-0" in its exterior wall to accommodate a test device. The facility has been well documented in published literature.

Two devices were created for the test. The first device was an embodiment of an airflow panel including a heat and moisture exchanger core. This comprised an exterior housing of nominal dimensions 4'-0"×3'-0"×10", containing a polymer membrane barrier substantially parallel to the largest surface area faces of the exchanger housing, disposed to subdivide the housing into sub-channels. A first subchannel was in fluid communication with the exterior environment outside the chamber and the chamber interior via louvered openings in the major faces (both exterior-facing and interior-facing) of the exchanger housing. The first subchannel was disposed to accept an incoming airstream induced to flow from the exterior through the first subchannel to the test chamber interior via a fan.

A second subchannel B was also in fluid communication with exterior and chamber interior environments via a pathway separated from the incoming air pathway that included louvered openings in the major faces of the exchanger housing. The second subchannel, which was disposed parallel to the first subchannel, was disposed to accept an exhaust airstream to flow from the chamber interior through the second subchannel to the exterior via a fan. A single layer of 1" thick extruded polystyrene sheet insulation was adhered to all interior surfaces of the exchanger housing. The airflow panel used in these experiments may have been similar to that shown in FIG. 3.

The second device, used as an experimental control, comprised an exterior housing of identical dimensions and material to the first. An incoming airstream was induced via a fan to flow from the exterior environment to the chamber interior in a fluidly communicating pathway passing directly through the housing in the shortest possible pathway. An exhaust airstream was induced via a fan to flow from the chamber interior to the external environment in a separate fluidly communicating pathway also passing directly through the housing in the shortest possible pathway. A single layer of 1" thick extruded polystyrene sheet insulation was adhered to all interior surfaces of the exchanger housing. Each device was installed into the aperture in one of the two MoWitt Climate Chambers.

The experimental devices were calibrated such that they could be operated at known airflow rates. Both devices were instrumented to measure temperature and relative humidity levels of the external environment, the chamber interior, the incoming air stream at its point of entry into the chamber, and the exhaust airstream at its point of exiting the exchanger housing. Additionally, paired temperature measurements were made on the inner and outer faces of the insulation layer disposed toward the exterior of the chamber. The paired temperature measurements were evenly spaced grid of nine points arrayed over the insulation surface.

Data was collected under a variety of conditions between Jul. 25th and Aug. 18, 2013. Fifteen individual, steady-state data points were measured, each consisting of average of five-minute interval values over a 30-minute period with the lowest standard deviations in the data set. From the measured data, state point values of the airstreams such as specific humidity levels, moist air densities, and heat- and mass-flow rates at various points within the system were determined.

Figure 9:
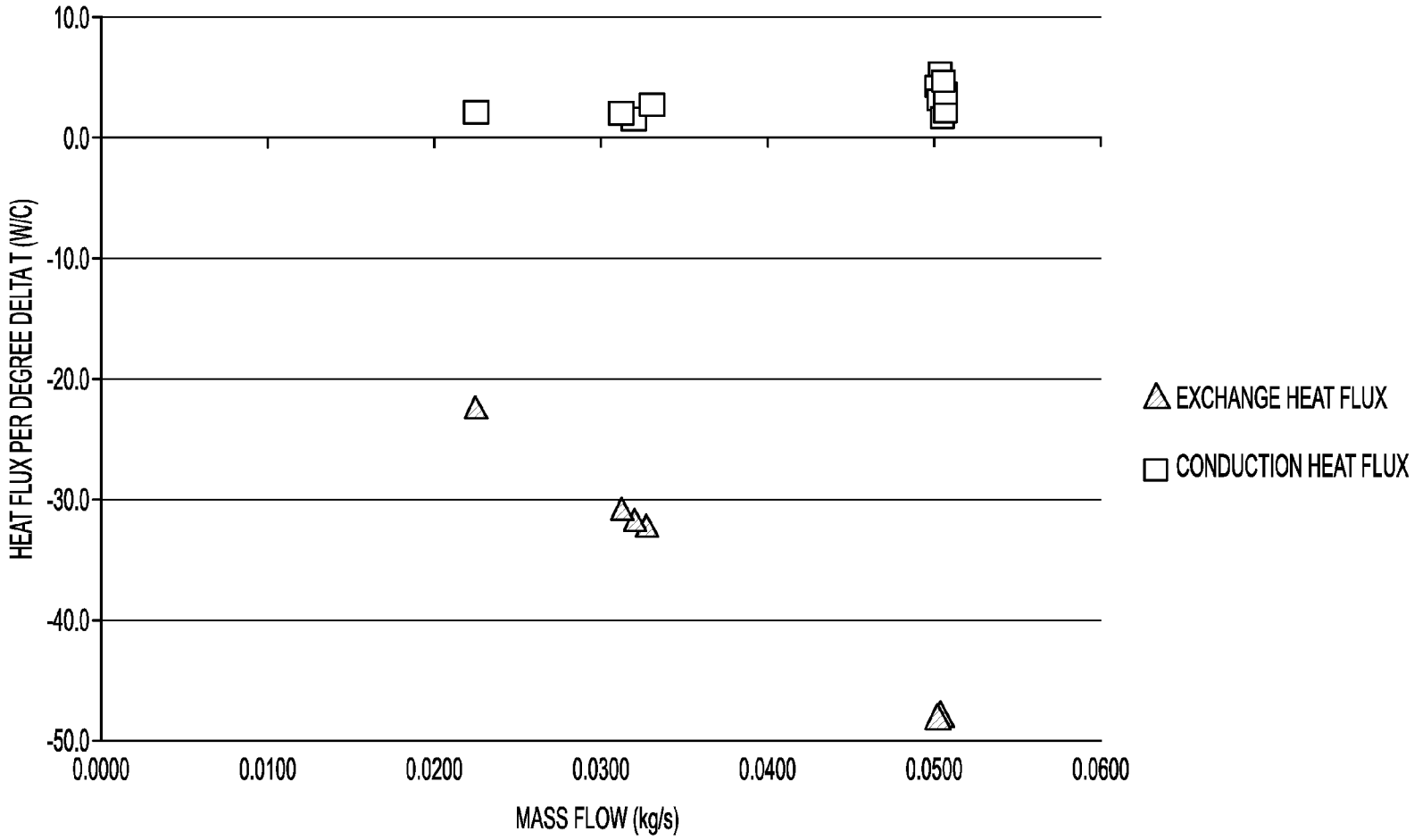
FIG. 9 is a graph of exemplary data showing that the rate of heat flux conducted into an air gap in a multi-layer building wall structure depends on the flow rate of air through a heat and moisture exchanger.

FIG. 9 is a graphical representation of data from the first device in the above described experiments, i.e. the inventive device. The y-axis represents heat flux per degree temperature difference, measured in units of Watts per degree Celsius. Heat flux is the rate of heat energy transferred from one place to another. In the case of the data labeled "Exchange Heat Flux", the data represents heat energy transferred between the input air and the exhaust air within the device. In the case of the data labeled "Conduction Heat Flux", the data represents heat transferred across the width of the entire device, from one outside surface to the other. As the experiments described above were conducted for a variety of different differences between the temperatures of the interior space and the exterior ambient space, the data is represented as heat flux divided by this temperature difference.

The x-axis represents mass flow rate, measured in kilograms per second. As described above, the flows of input and output air may be driven by adjustable fans.

Regarding the Exchange Heat Flux, the data in FIG. 9 shows that the magnitude of the energy transfer between the input and exhaust air streams increases approximately linearly with mass flow rate. Thus, it is clear that the Exchange Heat Flux can be controlled by adjusting one or both of the air flow rates. In cases where the exhaust air is vented into a gap between the building shield (or rain screen) containing the heat and moisture exchanger, it is therefore possible to control the temperature of the air within the gap, and therefore to control the moisture within the gap. In other words, controlling the input air flow rate and/or the exhaust air flow rate provides a desired amount of heat exchange between the building shield and the gap, thus controlling moisture content in the gap.

Regarding the Conduction Heat Flux, the data in FIG. 9 also demonstrates increasing heat flux with heat flux with increasing mass flow rate. More specifically, as the air flow rate varies from around 0.025 kg/s to around 0.5 kg/s, the average conductive heat flux across the building shield varies from approximately 0.4 W/C to approximately 0.8 W/C. Thus, in embodiments where the interior face of the building shield faces a gap of air between an outer façade and an inner façade of the building, this variation in heat conduction with air flow rate provides another mechanism to control the amount of heat that flows into the gap from the interior face of the panel by adjusting the flow rate of the air within the panel. This conductive heat transfer mechanism is present regardless of whether or not the exhaust air from the exchanger is vented directly into the gap.

In summary, some of the embodiments described herein include an air gap within a multi-layer building wall structure, disposed between a weather-resistant building shield and an inner building facade. Water may collect in this air gap by condensation on the interior surfaces of the gap, by penetrating through apertures in the building shield, or as water vapor present in the atmosphere. By controlling at least one of the input air flow rate and the exhaust air flow rate, the amount of heat exchanged between the airflow panel and the air in the gap may be controlled by two different and independent heat transfer mechanisms. Specifically, the heat transferred to the air in the gap may be conducted across the inner surface of the airflow panel into the gap, or transferred by exhaust air flowing into the gap, or both. Since both of these heat transfer mechanisms depend upon the flow rates of input and exhaust air, controlling these air flow rates can be used to provide a desired amount of heat exchange between the building shield (which also may be referred to as a rain screen or building outer façade) and the gap, thereby controlling the moisture content within the gap.

Example 6

Figure 10:
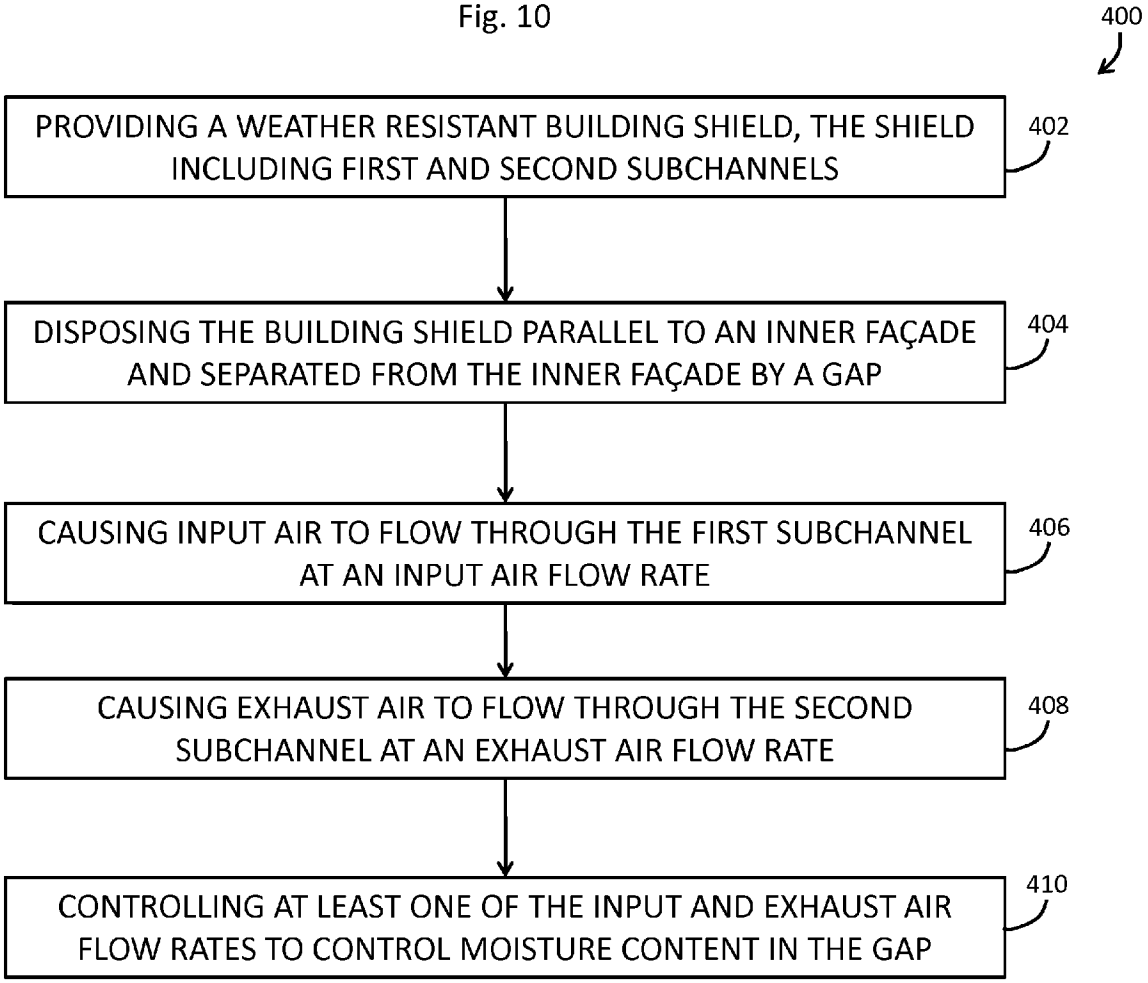
FIG. 10 is a flow chart depicting a method of controlling moisture reaching a building façade, according to aspects of the present teachings.

This example describes an illustrative method for controlling moisture reaching a building façade, which may be used in conjunction with any of the apparatuses described herein, as shown in FIG. 10.

FIG. 10 depicts multiple steps of a method, generally indicated at 400, for controlling moisture reaching a building façade. Method 400 may be used in conjunction with any of the airflow panels or heat and moisture exchange systems described in reference to FIGS. 1-9. Although various steps of method 400 are described below and depicted in FIG. 10, the steps need not necessarily all be performed, and in some cases may be performed in a different order than the order shown.

Method 400 may include a step 402 of providing a weather resistant building shield, the shield including first and second subchannels. The shield may include an exterior weather-resistant face, and interior face, and a membrane parallel to and disposed between the exterior and interior faces. The membrane may divide an internal channel of the building shield into the first and second subchannels. Any of airflow panels 100, 150, and/or 202 may be such a weather resistant building shield. The building shield may form all or a portion of a building outer façade.

The building shield may include a heat and moisture exchanger between the interior face and the exterior weather resistant face. The heat and moisture exchanger may include the first and second subchannels. Heat and moisture exchanger 10 described in reference to FIG. 1 may be such an exchanger.

The building shield may include a first intake allowing fluid communication between an environment external to a building and the first subchannel and a first egress allowing fluid communication between the first subchannel and the interior of the building. The building shield may include a second intake allowing fluid communication between an interior of the building and the second subchannel and a second egress allowing fluid communication between the second subchannel and the environment external to the building.

The first intake and the second egress may be physically separated by a distance sufficient to eliminate recirculation of exhaust air into the building. For example, in airflow panel 100 the first intake 114 may be fluidly connected to an exterior ambient environment through the first opening 110 and the second egress 120 may be fluidly connected to the exterior ambient environment through the second opening 112, see FIG. 2. The first and second openings may be spaced apart from one another on the exterior surface of the panel. In another example, in airflow panel 202, the input port 254 and the exhaust port 270 are on opposite sides of the peripheral surface 114 of the airflow panel, see FIG. 7.

The second intake and the first egress may be respectively connected to first and second sub-passageways of a bifurcated air passageway extending across the gap and fluidically connecting the building shield with the interior of the building. For example, in heat and moisture exchange system 200 described in reference to FIGS. 4-8, the second intake may include the return box 250. The air passageway extending across the gap may be boot 226 extending across air gap 234. The first sub-passageway of a bifurcated air passageway may be first passageway 242 within the bifurcated boot 226. The first egress may include the supply box 246. The second sub-passageway of the bifurcated air passageway may be the second passageway 244 within the bifurcated boot 226. The interior of the building 228 may be fluidically connected to the airflow panel 202 of the building shield through bifurcated boot 226 and bifurcated conduit 232.

The air passageway may be split in the vicinity of the building interior into physically separated first and second sub-passageways that penetrate the building at distinct locations. For example, in the heat and moisture exchange system 200 described in reference to FIGS. 4-8, the air passageway through the bifurcated boot 226 may split into first and second sub-passageways, the first of which may penetrate the finished interior wall 253 of the building at return box 250 and the second of which may penetrate the finished interior wall 253 of the building at supply box 246. The return and supply boxes may be spaced from one another at distinct locations. The distinct locations may be physically separated by a distance sufficient to eliminate immediate exhaust of fresh input air from the building.

Method 400 may include a step 404 of disposing the building shield parallel to an inner façade and separated from the inner façade by a gap. That is, the interior face of the shield may be parallel to the inner façade. The exterior face of the building shield may be exposed to an environment external to the building. The inner façade of the building may be a front surface of the building. The building shield may form all or a portion of an outer façade of the building and the exterior face of the outer façade may be exposed to conditions of an ambient outdoor environment.

For example, in heat and moisture exchange system 200 described in reference to FIGS. 4-8, the airflow panel 202 may form a building shield and the interior face 212 of the panel may be separated from the structural member 220 or the insulation layer 222 by the air gap 234.

Method 400 may include a step 406 of causing input air to flow through the first subchannel at an input air flow rate. The input air may flow into the first intake, through the first subchannel and out of the first egress at the input air flow rate. The input air may flow from the ambient outdoor environment external to the building into and through the first subchannel of a heat and moisture exchanger, across the gap, through the inner façade, and into an interior of the building.

Causing input air to flow into the interior of the building may include causing input air to flow from the building shield and through an air passageway which spans the gap and this fluidically connects the building shield to the interior of the building. A portion of the passageway may be bifurcated into first and second sub-passageways. The input air may flow from the building shield to the interior of the building through the first sub-passageway and the exhaust air may flow from the interior of the building to the building shield through the second sub-passageway. Portions of the first and second sub-passageways may be separated into distinct air passages which fluidically connect the building shield to two physically separated locations of the interior of the building. The two physically separated locations may be separated by a distance sufficient to eliminate immediately exhausting the input air.

For example, heat and moisture exchange system 200 described in reference to FIGS. 4-8 may be capable of performing step 406. Airflow panel 202 of exchange system 200 may include a heat and moisture exchanger core 208 which may be similar to heat and moisture exchanger 10.

The bifurcated air passageway may be split into first and second physically separated air passages in the immediate vicinity of the building inner façade. The first and second air passages may penetrate the building inner façade at locations separated by a distance sufficient to avoid exhausting fresh input air from the building. For example, as seen in FIG. 7, the air passageway in bifurcated boot 226 may split into first and second air passages in the immediate vicinity of the finished interior wall 253, between the structural member 220 and the finished interior wall 253. The first air passage may connect to the return box 250 and the second passage may connect to the supply box 246.

Method 400 may include a step 408 of causing exhaust air to flow through the second subchannel at an exhaust air flow rate. The exhaust air may flow into the second intake, through the second sub channel and out of the second egress at the exhaust air flow rate. The exhaust air may flow from the interior of the building, across the gap, into and through the second subchannel of a heat and moisture exchanger, and into the ambient outdoor environment external to the building at an exhaust air flow rate. The second subchannel may be separated from the first subchannel by a moisture permeable, gas-impermeable barrier.

Causing exhaust air to flow to the environment external to the building may include causing exhaust air to flow directly into the gap. For example, in heat and moisture exchange system 200, the stream of exhaust air B may exit the airflow panel 202 directly into airflow gap 234 through one or more exhaust port(s) 270. From the air gap 234, exhaust air may then exit to the environment external to the building by flowing out through louvers 218 or through the open joints 236 between adjacent panels.

Alternately, causing exhaust air to flow to the environment external to the building may include causing exhaust air to flow out of the building shield through the exterior weather-resistant face. For example, in airflow panels 100 and 150, the stream of exhaust air B may exit the panels through lower opening 112 and upper opening 168 respectively, in the weather resistant exterior faces 106 and 156.

In steps 406 and 408, causing input air to flow from the environment external to the building and into the first subchannel of the exchanger may include causing input air to flow into an air ingress in the building shield. Causing exhaust air to flow to the environment external to the building may include causing exhaust air to flow out of an air egress in the building shield. The air ingress and the air egress may be physically separated by a distance sufficient to eliminate recirculating exhaust air directly back into the building.

For example, in heat and moisture exchange system 200, the air ingress may be through upper louver 218 and into input port 254. The air egress may be through the one or more exhaust ports 270 and lower louver 218. In another example, in airflow panel 100, the air ingress may be through upper opening 110 and the air egress may be through lower opening 112.

In steps 406 and 408, causing input air to flow across the gap may include causing input air to flow through a first sub-passageway of a bifurcated air passageway extending across the gap. Causing exhaust air to flow across the gap may include causing exhaust air to flow through a second sub-passageway of the bifurcated passageway. For example, in heat and moisture exchange system 200, bifurcated boot 226 may extend across air gap 234 and boot 226 may include first and second sub-passageways 242 and 244 which may carry the input and exhaust air flow streams.

Method 400 may include a step 410 of controlling at least one of the input and exhaust air flow rates to control moisture content in the gap. Controlling at least one or the input airflow and exhaust air flow rates may provide a desired amount of heat exchange between the input air and the exhaust air. For example, as described in reference to the Exchange Heat Flux data represented in FIG. 9, the amount of heat exchanged between the input air and the exhaust air may depend on the mass flow rate of the streams. As the exhaust air may be vented directly into the gap, the flow of heat into the gap via the exhausted air may be controlled. As described in reference to the Conduction Heat Flux data represented in FIG. 9, the amount of heat exchanged between an interior face of an airflow panel and the gap may depend on the mass flow rate in the air streams.

Controlling at least one of the input air flow rate and the exhaust air flow rate may provide a desired amount of heat exchange between the building shield or outer facade and the gap. Thus, the flow of heat between the building shield or outer facade and the gap may be controlled by controlling the air flow rates in at least one of the input or exhaust streams. Setting the heat exchange to a desired amount may allow control over the moisture content in the gap.

Example 7

This example describes various inventive methods of controlling moisture reaching a building façade and/or ventilating the building, presented without limitation as a series of numbered paragraphs.

A. A method of controlling moisture reaching a building facade, comprising:

providing a weather-resistant building shield including:

an exterior weather-resistant face, an interior face, a membrane parallel to and disposed between the exterior face and the interior face and dividing an internal channel of the building shield into first and second subchannels, a first intake allowing fluid communication between an environment external to a building and the first subchannel, a second intake allowing fluid communication between an interior of the building and the second subchannel, a first egress allowing fluid communication between the first subchannel and the interior of the building, and a second egress allowing fluid communication between the second subchannel and the environment external to the building;

disposing the building shield with the interior face parallel to a building facade and separated from the facade by a gap, and with the exterior face exposed to an environment external to the building;

causing input air to flow into the first intake, through the first subchannel and out of the first egress at an input air flow rate;

causing exhaust air to flow into the second intake, through the second subchannel and out of the second egress at an exhaust air flow rate; and controlling at least one of the input air flow rate and the exhaust air flow rate to provide a desired amount of heat exchange between the building shield and the gap, thereby controlling moisture content in the gap.

A1. The method of paragraph A, wherein causing exhaust air to flow out of the second egress includes causing exhaust air to flow directly into the gap.

A2. The method of paragraph A, wherein causing exhaust air to flow out of the second egress includes causing exhaust air to flow through the exterior weather-resistant face.

A3. The method of paragraph A, wherein the first intake and the second egress are physically separated by a distance sufficient to eliminate recirculation of exhaust air into the building.

A4. The method of paragraph A, wherein the second intake and the first egress are respectively connected to first and second sub-passageways of a bifurcated air passageway extending across the gap and fluidically connecting the building shield with the interior of the building.

A5. The method of paragraph A4, wherein the air passageway is split in the vicinity of the building interior into physically separated first and second sub-passageways that penetrate the building at distinct locations.

A6. The method of paragraph A5, wherein the distinct locations are physically separated by a distance sufficient to eliminate immediate exhaust of fresh input air from the building.

B. A method of ventilating a building, comprising:

providing a building shield including a heat and moisture exchanger disposed between an interior face of the building shield and an exterior weather-resistant face of the building shield;

disposing the building shield with the interior face parallel to a front surface of a building and separated from the front surface by a gap, and with the exterior face exposed to an environment external to the building;

causing input air to flow from the environment external to the building into a first subchannel of the exchanger, through the first subchannel and into an interior of the building at an input air flow rate;

causing exhaust air to flow from the interior of the building into a second subchannel of the exchanger, through the second subchannel and to the environment external to the building at an exhaust air flow rate; and controlling at least one of the input air flow rate and the exhaust air flow rate to provide a desired amount of heat exchange between the input air and the exhaust air.

B1. The method of paragraph B, wherein causing exhaust air to flow to the environment external to the building includes causing exhaust air to flow directly into the gap.

B2. The method of paragraph B, wherein causing exhaust air to flow to the environment external to the building includes causing exhaust air to flow out of the building shield through the exterior weather-resistant face.

B3. The method of paragraph B, wherein causing input air to flow into the interior of the building includes causing input air to flow from the building shield and through an air passageway which spans the gap and thus fluidically connects the building shield to the interior of the building.

B4. The method of paragraph B3, wherein a portion of the air passageway is bifurcated into first and second sub-passageways, the input air flows from the building shield to the interior of the building through the first sub-passageway, and exhaust air flows from the interior of the building to the building shield through the second sub-passageway.

B5. The method of paragraph B4, wherein portions of the first and second sub-passageways are separated into distinct air passages which fluidically connect the building shield to two physically separated locations of the interior of the building.

B6. The method of paragraph B5, wherein the two physically separated locations are separated by a distance sufficient to eliminate immediately exhausting the input air.

B7. The method of paragraph B, wherein causing input air to flow from the environment external to the building into the first subchannel of the exchanger includes causing input air to flow into an air ingress in the building shield, causing exhaust air to flow to the environment external to the building includes causing exhaust air to flow out of an air egress in the building shield, and wherein the air ingress and the air egress are physically separated by a distance sufficient to eliminate recirculating exhaust air directly back into the building.

C. A method of controlling moisture reaching a building inner facade, comprising:

providing a building outer facade including a heat and moisture exchanger disposed between an interior face of the outer facade and an exterior weather-resistant face of the outer facade;

disposing the outer facade with its interior face parallel to a building inner facade and separated from the inner facade surface by a gap, and with its exterior face exposed to conditions of an ambient outdoor environment;

causing input air to flow from the ambient outdoor environment into a first subchannel of the exchanger, through the first subchannel, across the gap, through the inner facade and into the building at an input air flow rate;

causing exhaust air to flow from the building, across the gap, into a second subchannel of the exchanger separated from the first subchannel by a moisture permeable, gas-impermeable barrier, through the second subchannel and out to the ambient outdoor environment at an exhaust air flow rate; and controlling at least one of the input air flow rate and the exhaust air flow rate to provide a desired amount of heat exchange between the outer facade and the gap, thereby controlling moisture content within the gap.

C1. The method of paragraph C, wherein causing exhaust air to flow to the ambient outdoor environment includes causing exhaust air to flow from the building outer facade directly into the gap.

C2. The method of paragraph C, wherein causing exhaust air to flow to the ambient outdoor environment includes causing exhaust air to flow out of the building shield through the exterior weather-resistant face of the outer facade.

C3. The method of paragraph C, wherein causing input air to flow across the gap includes causing input air to flow through a first sub-passageway of a bifurcated air passageway extending across the gap, and causing exhaust air to flow across the gap includes causing exhaust air to flow through a second sub-passageway of the bifurcated air passageway.

C4. The method of paragraph C3, wherein the bifurcated air passageway is split into first and second physically separated air passages in the immediate vicinity of the building inner facade, and the first and second air passages penetrate the building inner facade at locations separated by a distance sufficient to avoid exhausting fresh input air from the building.

ADVANTAGES, FEATURES, BENEFITS

The different embodiments of the heat and moisture exchange systems described herein provide several advantages over known solutions for controlling the moisture content within an air gap of a multi-layer building wall structure. For example, the illustrative embodiments of exchange systems described herein allow for active control of the moisture content within the gap by controlling the heat flow into the gap from a heat and moisture exchanger panel. Additionally, and among other benefits, illustrative embodiments of the heat and moisture exchange systems described herein allow air to be preconditioned before entering an interior building space. Thus, the illustrative embodiments described herein are particularly useful for increasing energy efficiency of HVAC systems. However, not all embodiments described herein provide the same advantages or the same degree of advantage.

CONCLUSION

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only, and do not constitute a characterization of any claimed invention. The subject matter of the invention(s) includes all novel and nonobvious combinations and subcombinations of the various elements, features, functions, and/or properties disclosed herein. The following claims particularly point out certain combinations and subcombinations regarded as novel and nonobvious. Invention(s) embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the invention(s) of the present disclosure.

What is claimed is:

1. A method of controlling moisture reaching a building facade, comprising:

providing a weather-resistant building shield including:

an exterior weather-resistant face, an interior face, a membrane parallel to and disposed between the exterior face and the interior face and dividing an internal channel of the building shield into first and second subchannels, a first intake allowing fluid communication between an environment external to the building and the first subchannel, a second intake allowing fluid communication between an interior of the building and the second subchannel, a first egress allowing fluid communication between the first subchannel and the interior of the building, and a second egress allowing fluid communication between the second subchannel and the environment external to the building;

disposing the building shield with the interior face parallel to a building facade and separated from the facade by a gap, and with the exterior face exposed to an environment external to the building;

causing input air to flow into the first intake, through the first subchannel and out of the first egress at an input air flow rate;

causing exhaust air to flow into the second intake, through the second subchannel and out of the second egress at an exhaust air flow rate; and controlling at least one of the input air flow rate and the exhaust air flow rate to provide a desired amount of heat exchange between the building shield and the gap, thereby controlling moisture content in the gap;

wherein causing exhaust air to flow out of the second egress includes causing exhaust air to flow directly into the gap without passing into the exterior weather resistant face.

2. The method of claim 1, wherein the first intake and the second egress are non-adjacent and physically separated by a distance which eliminates recirculation of exhaust air into the building.

3. The method of claim 1, wherein the second intake and the first egress are respectively connected to first and second sub-passageways of a bifurcated air passageway extending across the gap and fluidically connecting the building shield with the interior of the building.

4. The method of claim 3, wherein the air passageway is split in the vicinity of the building interior into physically separated first and second sub-passageways that penetrate the building at non-adjacent, distinct locations.

5. The method of claim 4, wherein the distinct locations are physically separated by a distance which eliminates immediate exhaust of fresh input air from the building.

6. A method of ventilating a building, comprising:

providing a building shield including a heat and moisture exchanger disposed between an interior face of the building shield and an exterior weather-resistant face of the building shield;

disposing the building shield with the interior face parallel to a front impermeable layer of the building and separated from the front impermeable layer by a gap, and with the exterior face exposed to an environment external to the building;

causing input air to flow from the environment external to the building into a first subchannel of the exchanger, through the first subchannel and into an interior of the building at an input air flow rate;

causing exhaust air to flow from the interior of the building into a second subchannel of the exchanger, through the second subchannel and to the environment external to the building at an exhaust air flow rate; and controlling at least one of the input air flow rate and the exhaust air flow rate to provide a desired amount of heat exchange between the building shield and the gap, thereby controlling moisture content in the gap;

wherein causing exhaust air to flow to the environment external to the building includes causing exhaust air to flow directly into the gap without passing into the building shield.

7. The method of claim 6, wherein causing input air to flow into the interior of the building includes causing input air to flow from the building shield and through an air passageway which spans the gap and thus fluidically connects the building shield to the interior of the building.

8. The method of claim 7, wherein a portion of the air passageway is bifurcated into first and second sub-passageways, the input air flows from the building shield to the interior of the building through the first sub-passageway, and exhaust air flows from the interior of the building and into the gap through the second sub-passageway.

9. The method of claim 8, wherein portions of the first and second sub-passageways are separated into distinct air passages which fluidically connect the building shield to two physically separated, non-adjacent locations of the interior of the building.

10. The method of claim 9, wherein the two physically separated locations are separated by a distance which eliminates immediately exhausting the input air.

11. The method of claim 6, wherein causing input air to flow from the environment external to the building into the first subchannel of the exchanger includes causing input air to flow into an air ingress in the building shield, causing exhaust air to flow to the environment external to the building includes causing exhaust air to flow directly into the gap without penetrating the building shield, and wherein the air ingress and an air egress are non-adjacent and physically separated by a distance which eliminates recirculating exhaust air directly back into the building.

12. A method of controlling moisture reaching a building inner facade, comprising:

providing a building outer facade including a heat and moisture exchanger disposed between an interior face of the outer facade and an exterior weather-resistant face of the outer facade;

disposing the outer facade with its interior face parallel to the building inner facade and separated from the inner facade surface by a gap, and with its exterior face exposed to conditions of an ambient outdoor environment;

causing input air to flow from the ambient outdoor environment into a first subchannel of the exchanger, through the first subchannel, across the gap, through the inner facade and into the building at an input air flow rate;

causing exhaust air to flow from the building, across the gap, into a second subchannel of the exchanger separated from the first subchannel by a moisture permeable, gas-impermeable barrier, through the second subchannel and out to the ambient outdoor environment at an exhaust air flow rate; and controlling at least one of the input air flow rate and the exhaust air flow rate to provide a desired amount of heat exchange between the outer facade and the gap, thereby controlling moisture content within the gap;

wherein causing exhaust air to flow to the ambient outdoor environment includes causing exhaust air to flow from the building outer facade directly into the gap without passing into the outer facade.

13. The method of claim 12, wherein causing input air to flow across the gap includes causing input air to flow through a first sub-passageway of a bifurcated air passageway extending across the gap, and causing exhaust air to flow across the gap includes causing exhaust air to flow through a second sub-passageway of the bifurcated air passageway.

14. The method of claim 13, wherein the bifurcated air passageway is split into first and second physically separated air passages in the immediate vicinity of the building inner facade, and the first and second air passages penetrate the building inner facade at non-adjacent locations separated by a distance which avoids exhausting fresh input air from the building.

* * * * *